US010315878B2

(12) United States Patent
Nakamura

(10) Patent No.: US 10,315,878 B2
(45) Date of Patent: Jun. 11, 2019

(54) SHEET CONVEYING DEVICE, SHEET DISCHARGING DEVICE INCORPORATING THE SHEET CONVEYING DEVICE AND IMAGE FORMING APPARATUS INCORPORATING THE SHEET CONVEYING DEVICE AND THE SHEET DISCHARGING DEVICE

(71) Applicant: Mitsutaka Nakamura, Kanagawa (JP)

(72) Inventor: Mitsutaka Nakamura, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/855,217

(22) Filed: Dec. 27, 2017

(65) Prior Publication Data

US 2018/0179010 A1 Jun. 28, 2018

(30) Foreign Application Priority Data

Dec. 28, 2016 (JP) ..... 2016-256775

(51) Int. Cl.
*B65H 29/22* (2006.01)
*B65H 43/06* (2006.01)
(Continued)

(52) U.S. Cl.
CPC ..... *B65H 29/22* (2013.01); *B65H 31/02* (2013.01); *B65H 43/02* (2013.01); *B65H 43/06* (2013.01);
(Continued)

(58) Field of Classification Search
CPC ... B65H 29/22; B65H 2553/612; B65H 43/06
(Continued)

(56) References Cited

U.S. PATENT DOCUMENTS 7,677,557 B2 * 3/2010 Ino ..... B65H 31/26 271/207
8,651,479 B2 * 2/2014 Onishi ..... G03G 15/6552 271/207
(Continued)

FOREIGN PATENT DOCUMENTS

JP 5-058545 3/1993
JP 2000-211809 8/2000
(Continued)

OTHER PUBLICATIONS

Extended European Search Report dated Jun. 5, 2018 issued in corresponding European Application No. 17211173.4.

*Primary Examiner* — Michael C McCullough
(74) *Attorney, Agent, or Firm* — Harness, Dickey & Pierce, P.L.C.

(57) ABSTRACT

A sheet conveying device, which is included in a sheet discharging device and an image forming apparatus, includes a contact body configured to rotate while contacting a sheet in conveyance, a shaft configured to rotate together with the contact body in a range of rotation of the contact body, a sheet detector configured to detect the sheet through detection of rotation of the shaft, and a rotary body support configured to rotatably support the contact body to the shaft, extending the range of rotation, in a same direction as the direction of rotation of the shaft. The sheet discharging device includes a sheet discharging body, a sheet stacker of the sheet discharged, and the above-described sheet conveying device. The sheet detector is a stack height detector configured to detec't that the height of the sheet stacked on the sheet stacker is equal to or higher than a predetermined height.

13 Claims, 25 Drawing Sheets

(51) Int. Cl.
*B65H 31/02* (2006.01)
*B65H 43/02* (2006.01)

(52) U.S. Cl.
CPC .. *B65H 2402/545* (2013.01); *B65H 2403/945* (2013.01); *B65H 2511/152* (2013.01); *B65H 2511/20* (2013.01); *B65H 2511/51* (2013.01); *B65H 2513/512* (2013.01); *B65H 2553/612* (2013.01); *B65H 2601/25* (2013.01); *B65H 2601/26* (2013.01); *B65H 2801/06* (2013.01)

(58) Field of Classification Search
USPC ..... 271/220
See application file for complete search history.

(56) References Cited

U.S. PATENT DOCUMENTS 9,302,878 B2 * 4/2016 Ono ..... B65H 31/02
2005/0035535 A1 * 2/2005 Ogata ..... B65H 31/02 271/220
2005/0281598 A1 * 12/2005 Hattori ..... G03G 15/6573 399/405
2007/0069454 A1 * 3/2007 Ino ..... B65H 31/26 271/220
2012/0112402 A1 * 5/2012 Onishi ..... G03G 15/6552 271/109
2012/0248682 A1 10/2012 Arikawa et al.
2014/0239578 A1 8/2014 Honda et al.
2015/0102551 A1 4/2015 Koga
2015/0307311 A1 * 10/2015 Ono ..... B65H 31/02 271/176

FOREIGN PATENT DOCUMENTS

JP 2000-219397 8/2000
JP 2002-062704 2/2002
JP 2002-128389 5/2002

* cited by examiner

SHEET CONVEYING DEVICE, SHEET DISCHARGING DEVICE INCORPORATING THE SHEET CONVEYING DEVICE AND IMAGE FORMING APPARATUS INCORPORATING THE SHEET CONVEYING DEVICE AND THE SHEET DISCHARGING DEVICE

CROSS-REFERENCE TO RELATED APPLICATION

This patent application is based on and claims priority pursuant to 35 U.S.C. § 119(a) to Japanese Patent Application No. 2016-256775, filed on Dec. 28, 2016, in the Japan Patent Office, the entire disclosure of which is hereby incorporated by reference herein.

BACKGROUND

Technical Field

This disclosure relates to a sheet conveying device, a sheet discharging device, and an image forming apparatus incorporating the sheet conveying device and the sheet discharging device.

Related Art

Sheet discharging devices that discharge a sheet are known to employ a photointerrupter to detect that the height of stack of image printed sheets in a sheet ejection tray has reached a predetermined height or above, and a feeler that projects upward from the sheet ejection tray and swings in a vertical direction such that the photointerrupter detects the feeler when the amount of loaded sheets on the sheet ejection tray is equal to or above the predetermined amount.

In a known sheet discharging device, a part of a full detection feeler that functions as a feeler projecting upwardly from the sheet ejection tray to contact a sheet on the sheet ejection tray can retreat manually, in order to connect a post processing device immediately after the sheet discharging device. The full detection feeler vertically swings in a regular printing mode and is manually changed in a retreating direction that is perpendicular to the vertical direction when the feeler contacts the sheet discharging device.

However, the sheet discharging device has a problem that, when a sheet is picked up from the sheet ejection tray, the sheet to be picked up is caught by the full detection feeler, and therefore the operability is deteriorated and the full detection feeler is damaged or broken.

Further, in order to connect the post processing device immediately after the sheet discharging device, the full detection feeler is manually retreated to a position at which the full detection feeler does not contact the sheet to be picked up. However, when the sheet is picked up while the full detection feeler is retreated to the above-described position, there are many operation processes to take, which is troublesome.

Furthermore, when the machine is operated (when the printing operation is performed), the full detection feeler needs to be returned manually before the operation. Therefore, when the full detection feeler is not returned, the sheet full state is not detected. Accordingly, prevention of a sheet stacking failure and a paper jam is fairly costly.

SUMMARY

At least one aspect of this disclosure provides a sheet conveying device including a contact body, a shaft, a sheet detector and a rotary body support. The contact body is configured to rotate while contacting a sheet in conveyance. The shaft is configured to rotate together with the contact body in a range of rotation of the contact body. The sheet detector is configured to detect presence of the sheet through detection of rotation of the shaft rotating with the contact body in contact with the sheet. The rotary body support is configured to rotatably support the contact body to the shaft that rotates together with the contact body in contact with the sheet, extending the range of rotation, in a same direction as the direction of rotation of the shaft.

Further, at least one aspect of this disclosure provides a sheet discharging device including a sheet discharging body, a sheet stacker and the above-described sheet conveying device. The sheet discharging body is configured to discharge the sheet. The sheet stacker is a stacker on which the sheet is discharged by the sheet discharging body. The sheet detector is a stack height detector configured to detect that the height of the sheet stacked on the sheet stacker is equal to or higher than a predetermined height.

Further, at least one aspect of this disclosure provides an image forming apparatus including one of the above-described sheet conveying device and the above-described sheet discharging device.

BRIEF DESCRIPTION OF THE SEVERAL VIEWS OF THE DRAWINGS

An exemplary embodiment of this disclosure will be described in detail based on the following figured, wherein.

DETAILED DESCRIPTION

Figure 1B:
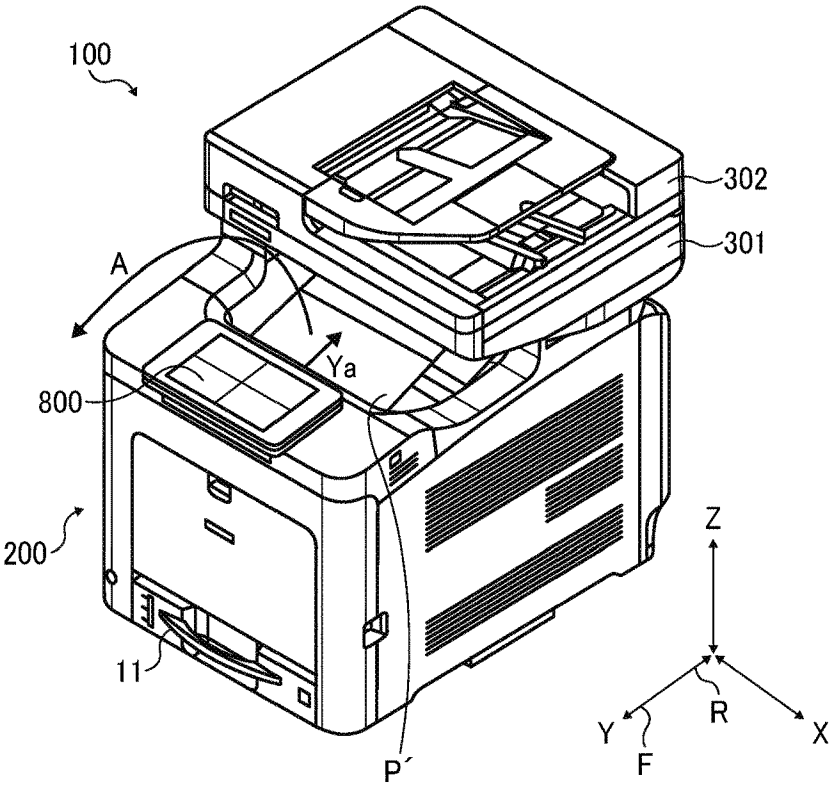
FIGS. 1A and 1B are perspective views illustrating an exterior of an image forming apparatus according to an embodiment of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described. Elements (for example, mechanical parts and components) having the same functions and shapes are denoted by the same reference numerals throughout the specification and redundant descriptions are omitted.

Here, it is to be noted in the following embodiments and variations that the term "swing" indicates a swing motion and a rotation in a forward direction and a backward direction at an angle of 360 degrees or smaller.

Now, a description is given of an electrophotographic image forming apparatus 100 for forming images by electrophotography.

First, a description is given of an exterior of an image forming apparatus 100 according to an embodiment of this disclosure, with reference to FIG. 1.

Figure 1A:
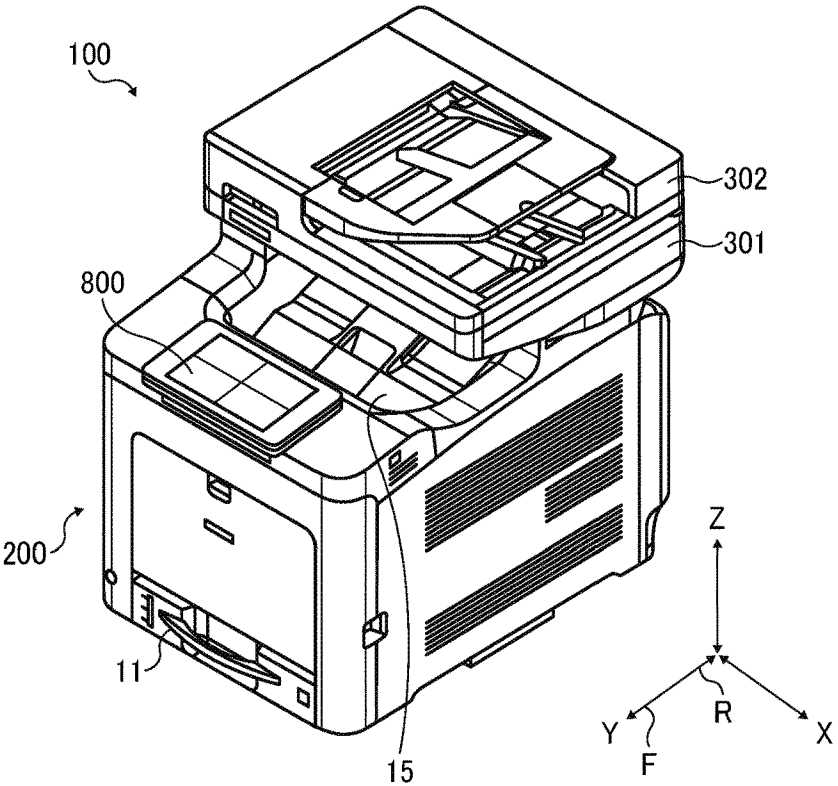

FIGS. 1A and 1B are perspective views illustrating the exterior of the image forming apparatus 100 according to an embodiment of this disclosure.

It is to be noted that identical parts are given identical reference numerals and redundant descriptions are summarized or omitted accordingly.

The image forming apparatus 100 may be a copier, a facsimile machine, a printer, a multifunction peripheral or a multifunction printer (MFP) having at least one of copying, printing, scanning, facsimile, and plotter functions, or the like. According to the present example, the image forming apparatus 100 is an electrophotographic printer that prints toner images on recording media by electrophotography.

It is to be noted in the following examples that: the term "image forming apparatus" indicates an apparatus in which an image is formed on a recording medium such as paper, OHP (overhead projector) transparencies, OHP film sheet, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium; and the term "sheet" is not limited to indicate a paper material but also includes the above-described plastic material (e.g., a OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, size (dimension), material, shape, and relative positions used to describe each of the components and units are examples, and the scope of this disclosure is not limited thereto unless otherwise specified.

Further, it is to be noted in the following examples that: the term "sheet conveying direction" indicates a direction in which a recording medium travels from an upstream side of a sheet conveying path to a downstream side thereof; the term "width direction" indicates a direction basically perpendicular to the sheet conveying direction.

In FIG. 1, "X" indicates a width direction of the image forming apparatus 100, "Y" indicates a front-and-back direction that is perpendicular to the width direction X of the image forming apparatus 100, "Z" indicates a vertical direction that is perpendicular to the width direction X of the image forming apparatus 100 and also perpendicular to the front-and-back direction Y of the image forming apparatus 100, "Ya" indicates a sheet discharging direction that corresponds to a direction R of the front-and-back direction Y of the image forming apparatus 100.

The image forming apparatus 100 in FIGS. 1A and 1B is a multi-functional image forming apparatus that includes a color laser printer 200, an image reading device 301 and an auto document feeder (ADF) 302. The color laser printer 200 is an apparatus body of the image forming apparatus 100. The image reading device 301 that functions as a reading portion is disposed above the color laser printer 200 and includes a scanner and an image reading unit. The ADF 302 is a document feeding device disposed above the image reading device 301.

A sheet feed tray 11 is disposed at the lower part of the color laser printer 200. The sheet feed tray 11 is detachably attachable to the color laser printer 200 of the image forming apparatus 100 in the front-and-back direction Y and contains a sheet P or sheets P as sheet-shaped conveyance target member(s).

A sheet stacker 15 is disposed at the lower part of the color laser printer 200. The sheet stacker 15 stacks a printed sheet P' to be discharged after image formation performed in the color laser printer 200. The sheet stacker 15 receives the printed sheet P' to stack or load the printed sheet P' in a state in which the leading end of the printed sheet P' is directed to a downstream side of the sheet discharging direction Ya.

Further, a control unit 800 is disposed at an upstream side of the sheet discharging direction Ya of the sheet stacker 15 disposed above the color laser printer 200. The control unit 800 is an interface that is used when instructions for operation are sent to the image forming apparatus 100.

The image forming apparatus 100 is designed for users to perform various operations from one side thereof. That is, a user can operate the sheet feed tray 11, the sheet stacker 15 and the control unit 800 of the image forming apparatus 100 from a front side in the front-and-back direction Y of the image forming apparatus 100 (i.e., the left side of FIGS. 1A and 1B).

Due to the exterior configuration of the image forming apparatus 100 with the control unit 800 disposed on the front side, as illustrated in FIG. 1B, the printed sheet P' stacked on the sheet stacker 15 cannot be picked up horizontally or in a horizontal direction to a front side F of the front-and-back direction Y (i.e., to the upstream side of the sheet discharging direction Ya). That is, as indicated by arrow A in FIG. 1B, the printed sheet P' is firstly lifted upwardly in the vertical direction Z and then is pulled out to the front side F of the front-and-back direction Y.

Figure 2:
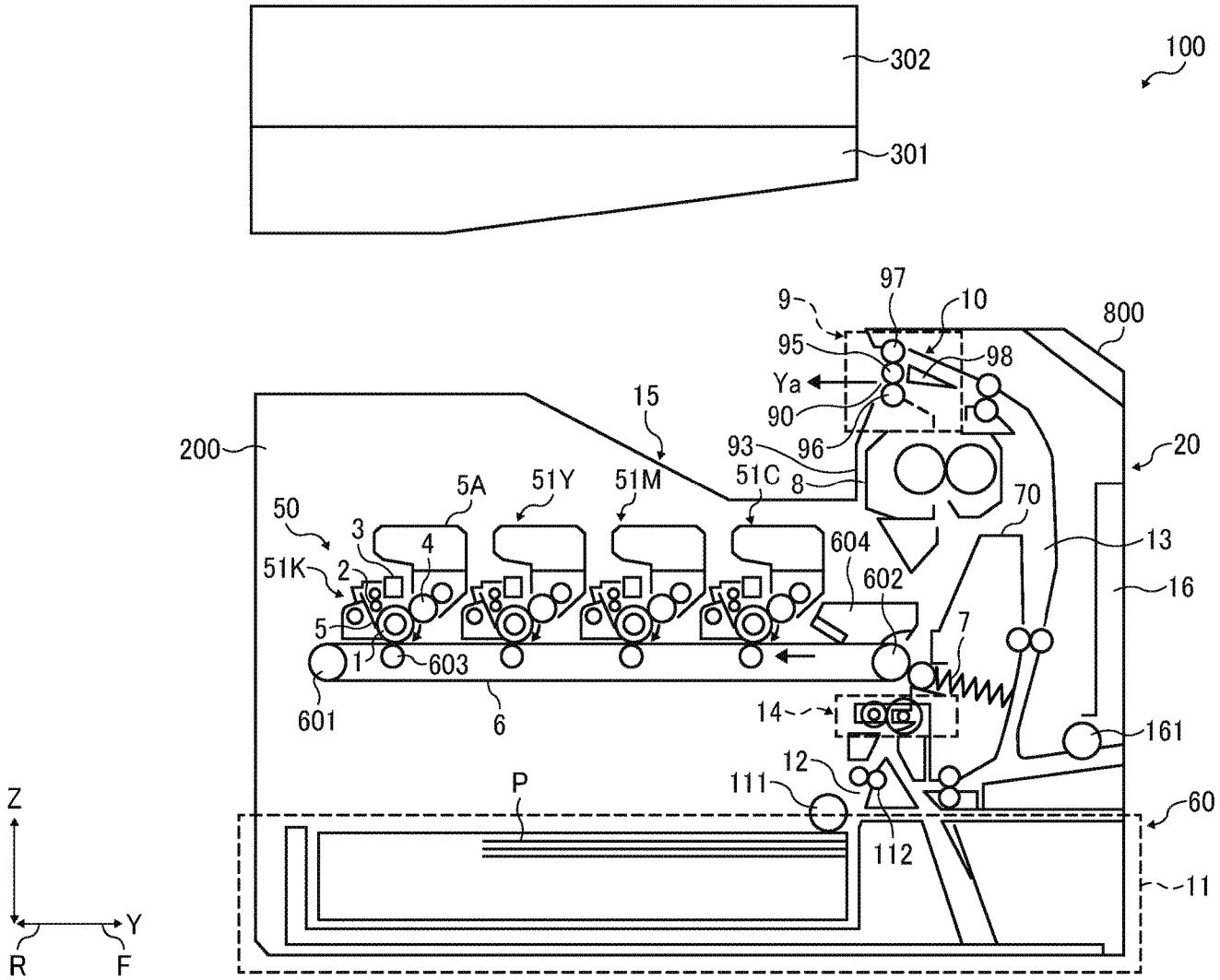
FIG. 2 is a cross sectional view illustrating the entire configuration of the image forming apparatus of FIG. 1.

Now, a description is given of the entire configuration and functions of the image forming apparatus 100 of FIGS. 1A and 1B, with reference to FIG. 2.

FIG. 2 is a cross sectional view illustrating the entire configuration of the image forming apparatus 100 of FIG. 1.

The color laser printer 200 includes an image forming device 50, a sheet feeding device 60, a fixing device 8 and a sheet discharging device 9. The image forming device 50 performs image formation by electrophotography. The sheet feeding device 60 feeds the sheet P from the sheet feed tray 11 to the image forming device 50. The fixing device 8 fixes an unfixed color or monochrome image transferred onto the sheet P in the image forming device 50 to the sheet P. The sheet P having a fixed toner image corresponds to the printed sheet P'. The sheet discharging device 9 functions as a recording medium discharging device to discharge the printed sheet P' to the sheet stacker 15 after printing (fusing).

The image forming device 50 has a tandem-type intermediate transfer system in which a full color toner image, a two-color toner image, a three-color toner image or a monochrome toner image is formed with four process cartridges 51. The process cartridges 51 are aligned corresponding to respective colors of black toner image, yellow toner image, magenta toner image and cyan toner image.

The four process cartridges 51 basically have an identical configuration to each other, except that the colors of respective toners used to form a color toner image are different. Therefore, the following description is given with reference numeral "51" without any suffix, K, Y, M and C, but is applied to any one of the process cartridges 51Y, 51M, 51C, and 51K. In FIG. 2, the reference numerals related to the process cartridge 51 are provided to the process cartridge 51 disposed at the extremely left side in the image forming apparatus 100.

The process cartridge 51 (i.e. the process cartridges 51K, 51Y, 51M and 51C) includes a photoconductor 1, a charging device 2, an exposure device 3, a developing device 4 and a cleaning device 5. The photoconductor 1 functions as a rotatable image bearer. The charging device 2 uniformly charges a surface of the photoconductor 1. The developing device 4 includes a developer cartridge 5A and supplies toner onto the electrostatic latent image formed on the surface of the photoconductor 1 so as to develop the electrostatic latent image into a visible toner image. The cleaning device 5 cleans the surface of the photoconductor 1 after the toner image is transferred onto an intermediate transfer belt 6. Since the photoconductor 1, the charging device 2, the exposure device 3, the developing device 4 and the cleaning device 5 are integrally assembled in the process cartridge 51 (i.e. the process cartridges 51K, 51Y, 51M and 51C), these image forming parts are detachably attached to the casing of the color laser printer 200.

The exposure device 3 is disposed between the charging device 2 and the developing device 4 in the color laser printer 200 as an apparatus body, for the photoconductor 1 of each process cartridge 51. The exposure device 3 includes an optical writing head. The optical writing head of the exposure device 3 includes a light emitting element that uses a light emitting diode (LED) array to emit a light beam onto the charged surface of the photoconductor 1 so as to form an electrostatic latent image on the photoconductor 1.

Through the operation instructed via the control unit 800, the instruction of a copying operation or a printing operation is sent to the image forming apparatus 100, the image formation starts in the image forming device 50. The instruction of a printing operation via the control unit 800 is sent when image data is stored in the image forming apparatus 100. The instruction of the printing operation is issued normally from a personal computer different from the image forming apparatus 100.

The copying operation is performed based on a result of reading by the image reading device 301, of an image formed on an original document conveyed from the ADF 302 or a result of reading by the image reading device 301, of an image formed on an original document placed on top of an exposure glass of the image reading device 301.

In image formation, the charging device 2 uniformly charges the surface of the photoconductor 1. Then, based on an image data signal after color separation, the exposure device 3 emits a laser light beam form the light emitting element of the optical writing head of the exposure device 3 to the surface of the photoconductor 1. Consequently, an electrostatic latent image is formed on the photoconductor 1 that rotates in a clockwise direction as indicated by arrows in FIG. 2.

Then, the developing device 4 includes the developer cartridge 5A that contains one-component developer (i.e., toner). As the developer cartridge 5A supplies toner, the developing device 4 develops the electrostatic latent image formed on the surface of the photoconductor 1 into a visible toner image with toner electrostatically attached thereto. It is to be noted that, when the developing device 4 uses two-component developer that includes toner and carrier, toner of the two-component developer is electrostatically attached to the electrostatic latent image on the photoconductor 1 to be developed into a visible toner image.

The above-described operations are performed in the four process cartridges 51 in parallel. The color laser printer 200 further includes primary transfer rollers 603 disposed opposing the respective photoconductors 1 with the intermediate transfer belt 6 therebetween. A primary transfer bias is applied to the intermediate transfer belt 6 and each primary transfer roller 603. The intermediate transfer belt 6 is in contact with the photoconductors 1. The respective toner images formed on the respective surfaces of the photoconductors 1 are sequentially transferred onto a surface of the intermediate transfer belt 6. It is to be noted that the intermediate transfer belt 6 functions as an intermediate transfer body and is wound around a drive roller 601 and a driven roller 602.

The transfer of the toner images from the photoconductors 1 onto the intermediate transfer belt 6 is performed at respect opposing positions of the photoconductors 1 facing the intermediate transfer belt 6. After the photoconductor 1 passes the opposing position to the intermediate transfer belt 6, residual toner remaining on the surface of the photoconductor 1 is removed by the cleaning device 5, so that the photoconductor 1 is cleaned.

Along with the above-described operations, a sheet feeding operation starts to feed the sheet P to the image forming device 50. The sheet P loaded in the sheet feed tray 11 is fed by rotation of a sheet feed roller 111. The sheet P is then passes a relay roller 112 disposed in a single-side conveyance passage 12, and brought to contact a nip region formed by a pair of registration rollers 14 that is temporarily stopped. Due to the contact of the sheet P to the nip region of the pair of registration rollers 14, the sheet is curved. Accordingly, after the sheet P is corrected on an angular displacement that is a displacement to an axial direction of the pair of registration rollers 14, the pair of registration rollers 14 starts the rotation thereof in synchronization with movement of the full-color toner image transferred onto the intermediate transfer belt 6. Then, the sheet P is conveyed to a secondary transfer nip region formed between the intermediate transfer belt 6 and a secondary transfer roller 7 via the driven roller 602. Then, the full-color toner image formed on the surface of the intermediate transfer belt 6 is applied with a secondary transfer bias having high electric potential by the secondary transfer roller 7. Due to generation of a potential difference between the intermediate transfer belt 6 and the secondary transfer roller 7, the full-color toner images formed on the intermediate transfer belt 6 is transferred onto the sheet P collectively.

The sheet P having the full-color toner image transferred thereon is fixed to the sheet P in the fixing device 8, by application of heat and pressure. Further, the printed sheet V to which the color toner image is fixed is conveyed by a sheet discharging roller 95 and a sheet discharging driven roller 96 of the sheet discharging device 9 and is then discharged form an outlet port 90 of the sheet discharging device 9 before being stacked sequentially in the sheet stacker 15. Accordingly, the printing operation is completed. The sheet discharging roller 95 and the sheet discharging driven roller 96 function as sheet discharging bodies by which the sheet P is discharged as the printed sheet P'.

By contrast, residual toner remaining on the surface of the intermediate transfer belt 6 without being transferred onto the sheet P at the secondary transfer nip region is removed by a belt cleaning device 604, so that the intermediate transfer belt 6 is cleaned.

The sheet stacker 15 is formed on top of the color laser printer 200, from the downstream side to the upstream side of the sheet discharging direction Ya (i.e., from the back side to the front side of the front-and-back direction Y) and being sloped toward the downward side in the vertical direction Z. The sheet stacker 15 has a sheet discharging rear end guide plate 93 that functions as a sheet discharging guide. The sheet discharging rear end guide plate 93 stands from the lowermost part of the sheet stacker 15, upwardly toward an outlet port 90. The sheet discharging guide is a member to regulate the position of the trailing end of the printed sheet P' stacked in the sheet stacker 15 (i.e., the sheet discharging rear end guide plate 93) and to separate from the fixing device 8 provided to the color laser printer 200.

The image forming apparatus 100 further includes a sheet reversing device 10. The sheet reversing device 10 reverses the sheet P having a toner image on a first face thereof and guide the reversed sheet P to a duplex sheet conveyance passage 13 for duplex printing. The sheet reversing device 10 includes the sheet discharging roller 95, a sheet reversing roller 97 and a passage switching member 98. The sheet discharging roller 95 and the sheet reversing roller 97 change and reverse the sheet conveying direction of the leading end and the trailing end of the sheet P. The passage switching member 98 switches the direction of the sheet P from the single-side conveyance passage 12 to the duplex sheet conveyance passage 13.

In addition, the image forming apparatus 100 further includes a bypass sheet tray 16 and a bypass sheet feed roller 161, both are used when the sheet P is inserted from the bypass sheet tray 16.

Further, the image forming apparatus 100 further includes a front cover 20 that opens and closed relative to the image forming apparatus 100. The front cover 20 opens to release and expose the locations of the pair of registration rollers 14 and the secondary transfer roller 7, disposed above the single-side conveyance passage 12. When the front cover 20 is open toward the front side in the front-and-back direction Y of the image forming apparatus 100 (i.e., on the right side of FIG. 2), the pair of registration rollers 14 and the secondary transfer roller 7 are exposed. Accordingly, a paper jam operation, maintenance check, and cleaning can be performed. The front cover 20 is also open to expose the duplex sheet conveyance passage 13. As illustrated in FIG. 2, the image forming apparatus 100 further includes a sheet conveying unit 70.

Now, a description is given of a full detection feeler 91 provided to the sheet discharging device 9.

Figure 3B:
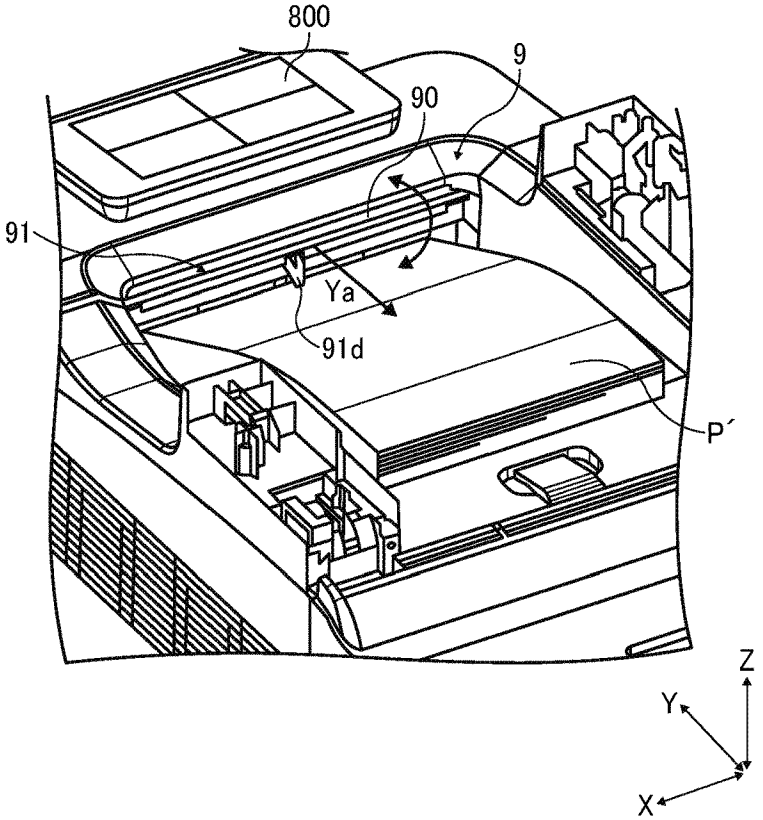
FIG. 3B is a diagram illustrating the full detection feeler provided to the sheet discharging device, when an amount of sheets discharged on the sheet stacker exceeds a predetermined sheet stacking amount.
Figure 3A:
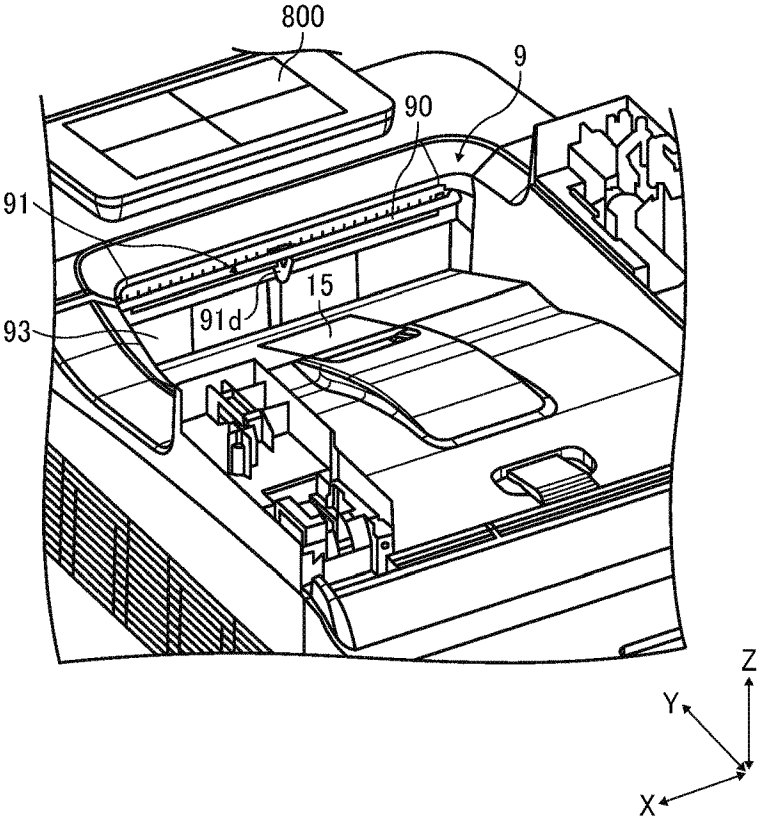
FIG. 3A is a diagram illustrating a full detection feeler provided to a sheet discharging device included in the image forming apparatus of FIG. 2, when no sheet is stacked on a sheet stacker.

FIG. 3A is a diagram illustrating the full detection feeler 91 provided to the sheet discharging device 9, when no sheet is stacked on the sheet stacker 15. Specifically, the amount of printed sheets P' on the sheet stacker 15 is smaller than and equal to a predetermined sheet stacking amount and the full detection feeler 91 stands by at a (home) position. FIG. 3B is a diagram illustrating the full detection feeler 91 provided to the sheet discharging device 9, when the amount of printed sheets P' discharged on the sheet stacker 15 exceeds the predetermined sheet stacking amount and the full detection feeler 91 is located at a detection position.

As illustrated in FIGS. 3A and 3B, the full detection feeler 91 is swingably disposed in the vicinity of the outlet port 90 through which the printed sheet P' is discharged toward the sheet stacker 15. The full detection feeler 91 includes a contact feeler portion 91*d* to contact the printed sheet P' being discharged. The contact feeler portion 91*d* is fixed to the full detection feeler 91 and integrally rotates and swings together with the full detection feeler 91 as a single unit. The full detection feeler 91 is swingably supported to swing within a predetermined swinging range as a predetermined rotating range, which is described below.

When the stacking amount of the printed sheets P' on the sheet stacker 15 is in an initial stacking state where the stacking amount is smaller than and equal to the predetermined stacking amount (FIG. 3A illustrates a state in which no printed sheet V is discharged on the sheet stacker 15), the full detection feeler 91 stands by a standby position as illustrated in FIG. 3A. It is to be noted that the term "standby position" is explained below.

As illustrated in FIG. 3B, when the stacking amount of the printed sheets P' on the sheet stacker 15 exceeds the predetermined stacking amount, the full detection feeler 91 contacts an uppermost printed sheet P' placed on top of a stack of the printed sheets P' on the sheet stacker 15. Based on the amount of swing of the full detection feeler 91 starting from the initial stacking state of the printed sheet P' on the sheet stacker 15, a full state of the printed sheets P' on the sheet stacker 15 is determined. The detailed description of this operation is described below.

Now, a description is given of a configuration of detection of a sheet full state of the printed sheets P' on the sheet stacker 15, with reference to FIGS. 4A through 4D.

Figure 4A:
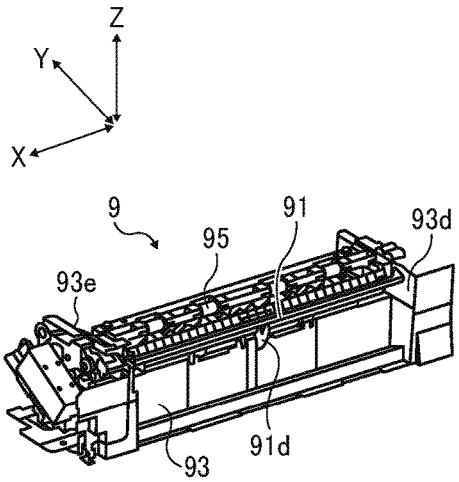
FIG. 4A is a perspective view illustrating the full detection feeler of the sheet discharging device of FIGS. 3A and 3B.
Figure 4B:
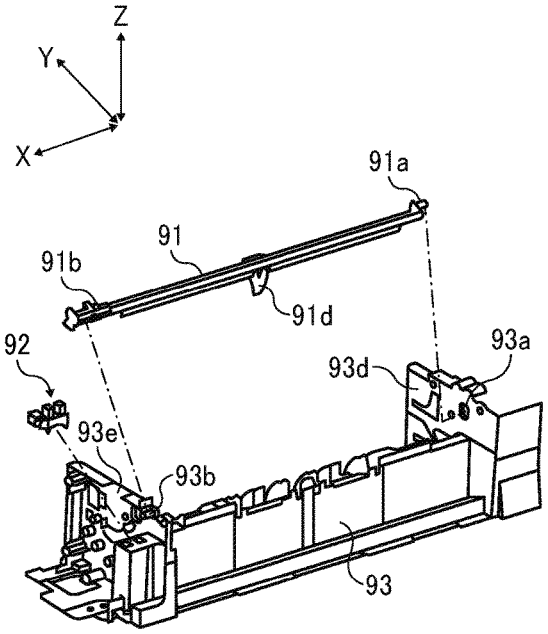
FIG. 4B is an exploded perspective view illustrating the configuration of detection of a sheet full state of the printed sheets.
Figure 4C:
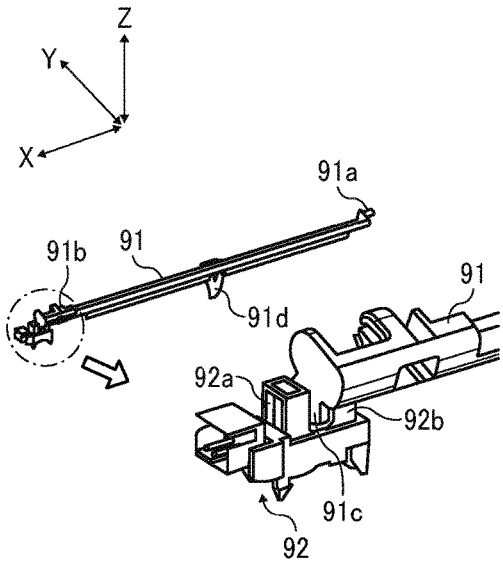
FIG. 4C is a perspective view illustrating a relation of a change of swing angle of a blocking member at the standby position of the full detection feeler and a detection by a photointerrupter.
Figure 4D:
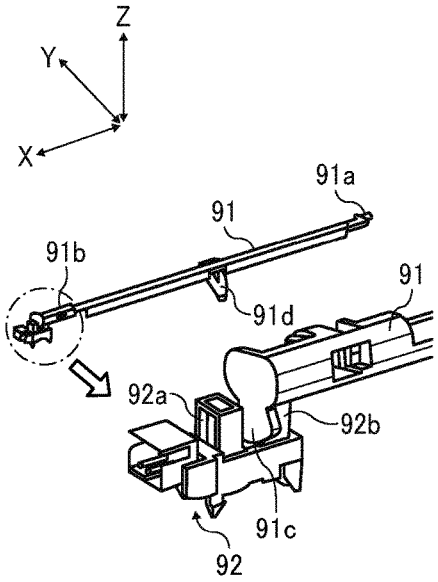
FIG. 4D is a perspective view illustrating a relation of the change of swing angle of the blocking member when the full detection feeler is in the sheet full state and the detection by the photointerrupter.

FIG. 4A is a perspective view illustrating the full detection feeler 91 of the sheet discharging device 9. FIG. 4B is an exploded perspective view illustrating the configuration of detection of the sheet full state of the printed sheets P'. FIG. 4C is a perspective view illustrating a relation of a change of swing angle of a blocking member 91*c* at the standby position of the full detection feeler 91 and a detection by a photointerrupter 92. FIG. 4D is a perspective view illustrating a relation of the change of swing angle of the blocking member 91*c* when the full detection feeler 91 is in the sheet full state and the detection by the photointerrupter 92.

As illustrated in FIG. 4A, the sheet discharging device 9 includes the sheet discharging rear end guide plate 93 and sheet discharging side guide plates 93*d* and 93*e*. The sheet discharging rear end guide plate 93 extends in the width direction X and the vertical direction Z. The sheet discharging side guide plates 93*d* and 93*e* are both left and right sides of the sheet discharging rear end guide plate 93 and extend in the front-and-back direction Y and the vertical direction Z. The sheet discharging rear end guide plate 93 has a surface to guide the trailing end of the printed sheet P'. The sheet discharging side guide plates 93*d* and 93*e* have respective surfaces to guide both ends of the printed sheet P'.

Further, the sheet discharging device 9 includes the full detection feeler 91 having the contact feeler portion 91*d*. Both left and right end portions of the full detection feeler 91 extend in the width direction X and are attached to and supported by the sheet discharging side guide plates 93*d* and 93*e*.

As illustrated in FIG. 4B, a first swing support 93*a* that functions as a first rotation support is disposed on the sheet discharging side guide plate 93*d* and a first swing support 93*b* that functions as a first rotation support is disposed on the sheet discharging side guide plate 93*e*. The first swing supports 93*a* and 93*b* are bearings.

On both ends in the width direction X of the full detection feeler 91, first swing target supports 91*a* and 91*b* that function as first rotation target supports are mounted integrally. The first swing target supports 91*a* and 91*b* are swing fulcrums as coaxial rotation fulcrums. The first swing target support 91*a* of the full detection feeler 91 is attached to and supported by the first swing support 93*a* of the sheet discharging side guide plate 93*d*. The first swing target support 91*b* of the full detection feeler 91 is attached to and supported by the first swing support 93*b* of the sheet discharging side guide plate 93*e*.

Further, a photointerrupter 92 is provided in the vicinity of the first swing support 93*b* of the sheet discharging side guide plate 93*e*.

As illustrated in FIG. 4C, the photointerrupter 92 is an optical transmissive photosensor having a light emitting part 92*a* and a light receiving part 92*b*. The photointerrupter 92 detects swing of the blocking member 91*c* attached to the end of the full detection feeler 91 that integrally swings together with the contact feeler portion 91*d* in contact with the printed sheet P'. By so doing, the photointerrupter 92 functions as a height detector to detect that the stacking amount of the printed sheets P' stacked in the sheet stacker 15 is equal to or greater than the predetermined height.

The blocking member 91*c* that functions as a light blocking portion mounted on the end portion of the full detection feeler 91 performs transmission and blockage of an optical path of the laser light beam emitted from the light emitting part 92*a*. By so doing, the light receiving part 92*b* generates a signal related to whether the sheet full state is detected or not.

Based on the signal related to whether the sheet full state is detected or not, sent from the light receiving part 92*b* of the photointerrupter 92, a controller included in the image forming apparatus 100 determines whether the sheet stacker 15 is full with the printed sheets P' or not, and finally determines whether the print job is interrupted or continued. The controller then sends an instruction signal to devices and mechanisms related to the print job to control the devices and the mechanisms.

As illustrated in FIG. 4C, when the full detection feeler 91 is in the standby state in which the stack amount of the printed sheets P' on the sheet stacker 15 is in the initial stacking state in which the stack amount of the printed sheets P' is equal to or smaller than a regular amount, light emitted from the light emitting part 92*a* of the photointerrupter 92 is blocked by the blocking member 91*c* of the full detection feeler 91.

As illustrated in FIG. 4D, when the full detection feeler 91 is in the sheet full stacking state, light emitted from the light emitting part 92*a* of the photointerrupter 92 is not blocked by the blocking member 91*c* of the full detection feeler 91 (in a light transmission state).

Now, a description is given of movement of the full detection feeler 91 during the print job, with reference to FIGS. 5A, 5B, 5C, 5D, 6A, 6B, 6C, 6D, 7A and 7B.

Figure 5A:
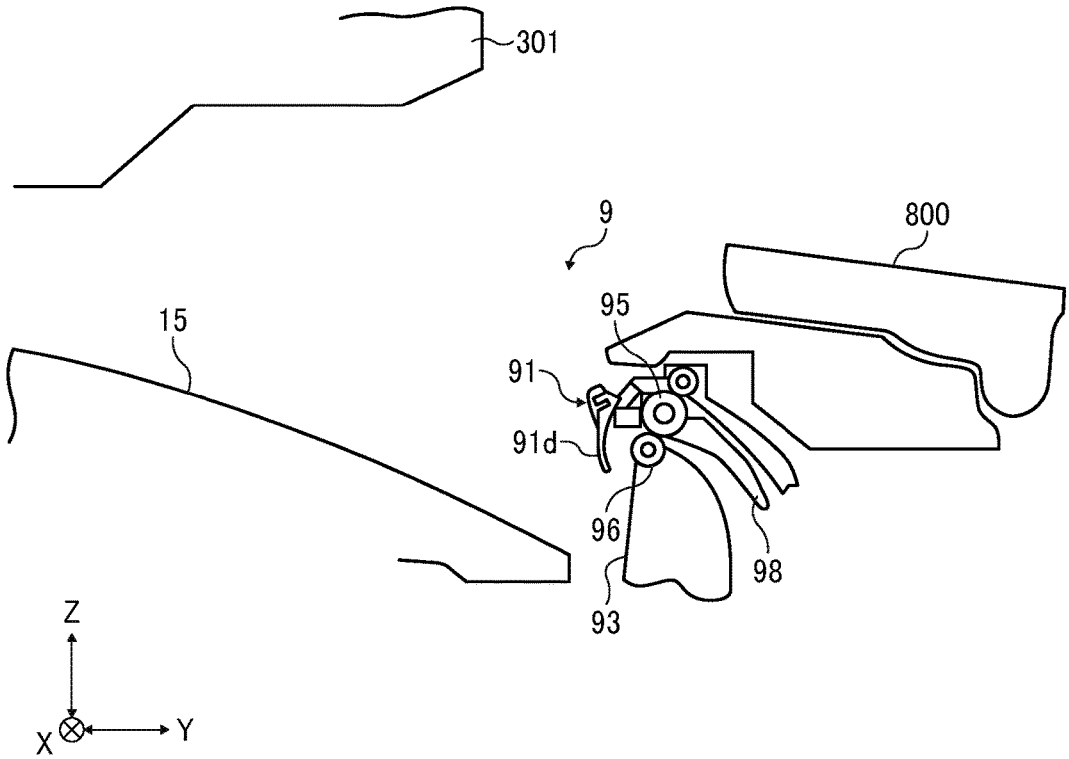
FIG. 5A is a cross sectional view illustrating the sheet stacker and the full detection feeler in an initial standby state during a print job.
Figure 5B:
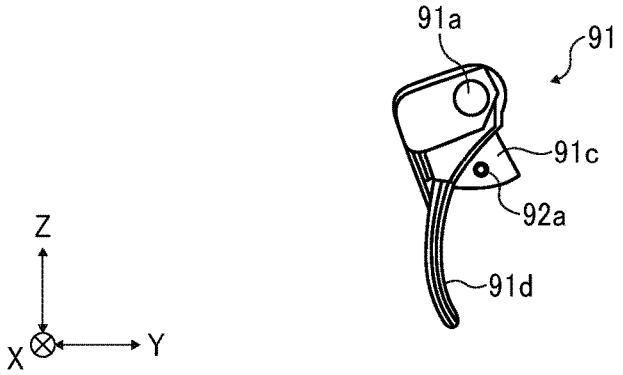
FIG. 5B is a cross sectional view illustrating movement of the full detection feeler during the print job of FIG. 5A.
Figure 6A:
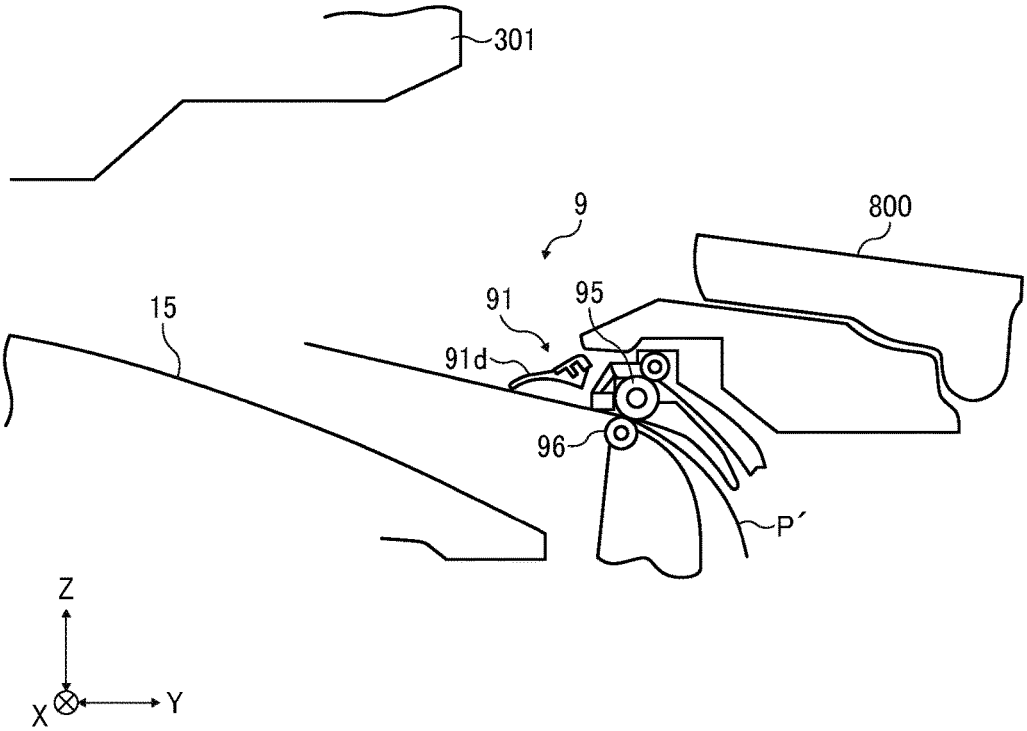
FIG. 6A is a cross sectional view illustrating the sheet stacker and the full detection feeler when the full detection feeler is in contact with the sheet during the print job.
Figure 6B:
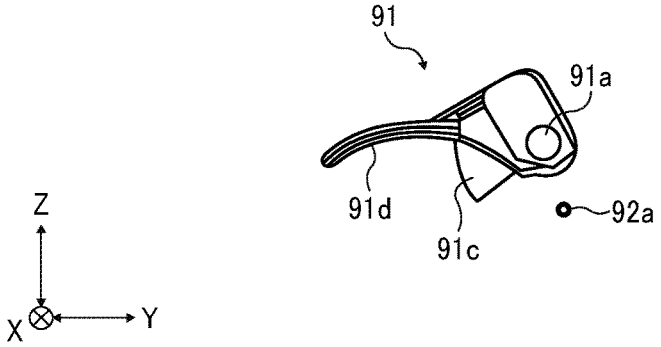
FIG. 6B is a cross sectional view illustrating movement of the full detection feeler during the print job of FIG. 6A.
Figure 7A:
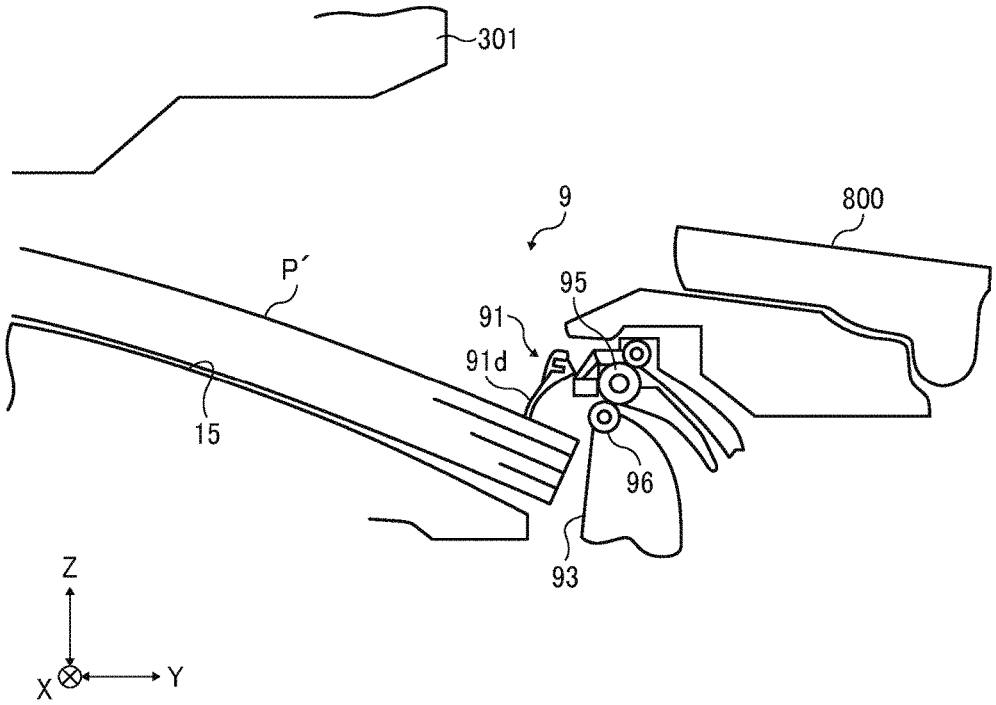
FIG. 7A is a diagram illustrating the sheet stacker and the full detection feeler when multiple sheets are stacked in the sheet stacker during the print job.
Figure 7B:
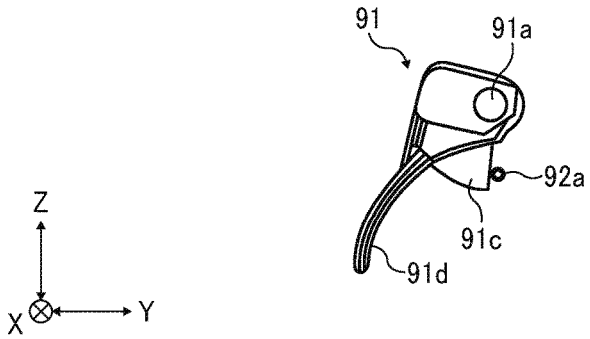
FIG. 7B is a cross sectional view illustrating movement of the full detection feeler during the print job of FIG. 7A.

Specifically, FIGS. 5A, 6A and 7A are cross sectional views illustrating the sheet stacker 15 and the full detection feeler 91. FIGS. 5B, 6B and 7B are enlarged views illustrating the full detection feeler 91 in the state illustrated in FIGS. 5A, 6A and 7A, respectively.

As illustrated in FIGS. 5A and 5B, the blocking member 91*c* of the full detection feeler 91 in the in the initial standby state blocks light (light path) from the light emitting part 92*a* of the photointerrupter 92.

At this time, the full detection feeler 91 is at a location occupying an equilibrium position (hereinafter, referred to as a "standby position") in the predetermined swinging range of the full detection feeler 91 by the own weight of the full detection feeler 91 including the contact feeler portion 91*d* (about the first swing target support 91*a*).

Figure 5C:
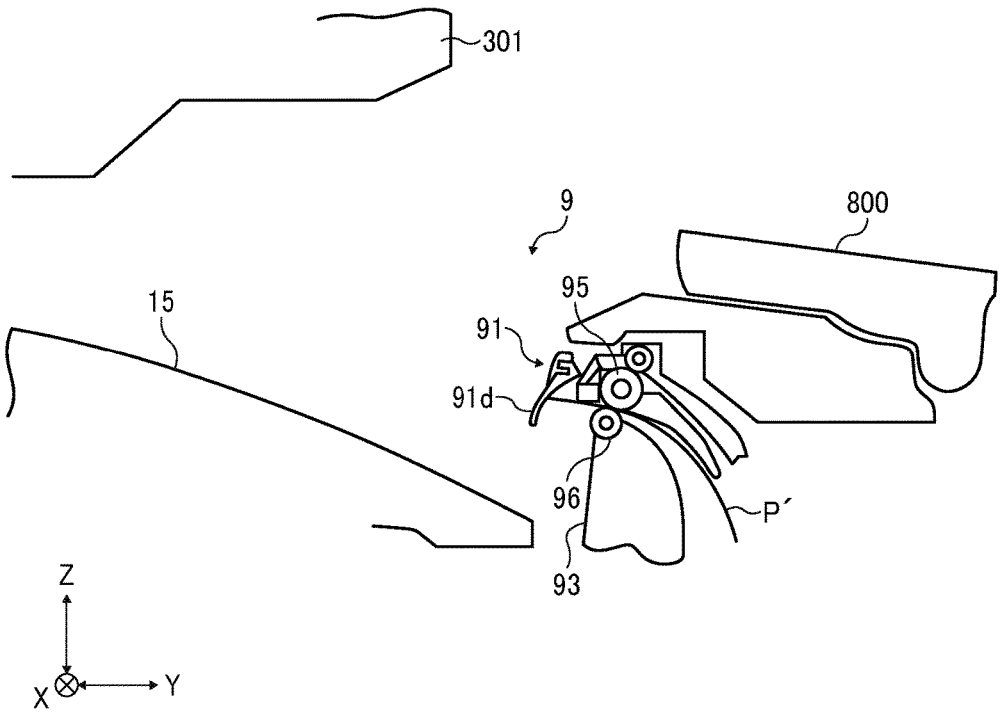
FIG. 5C is a cross sectional view illustrating the sheet stacker and the full detection feeler when the full detection feeler is in contact with the sheet during the print job.
Figure 5D:
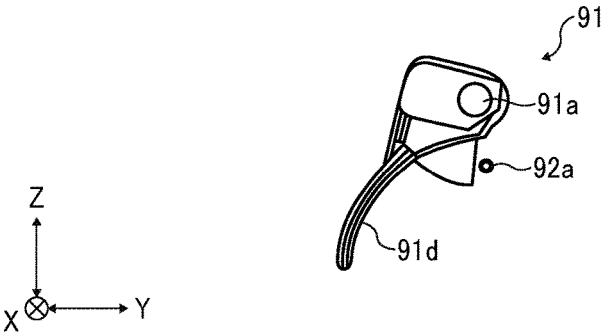
FIG. 5D is a cross sectional view illustrating movement of the full detection feeler when the full detection feeler is in contact with the sheet during the print job of FIG. 5C.

As the print job starts, the printed sheet P' conveyed from the fixing device 8 is guided by the sheet discharging roller 95 and the sheet discharging driven roller 96 toward the sheet discharging device 9. Then, as illustrated in FIGS. 5C and 5D, the printed sheet P' contacts the contact feeler portion 91*d* of the full detection feeler 91 to be conveyed by pushing and rotating the contact feeler portion 91*d*. At this time, the blocking member 91*c* rotates from a position at which light (or a light path) is blocked to a position at which the light (or the light path) is not blocked (i.e., the transmission state).

Further, as the printed sheet P' is conveyed, the printed sheet P' is further conveyed to the sheet stacker 15 by further pushing and rotating the contact feeler portion 91*d* of the full detection feeler 91, as illustrated in FIGS. 6A and 6B.

Figure 6C:
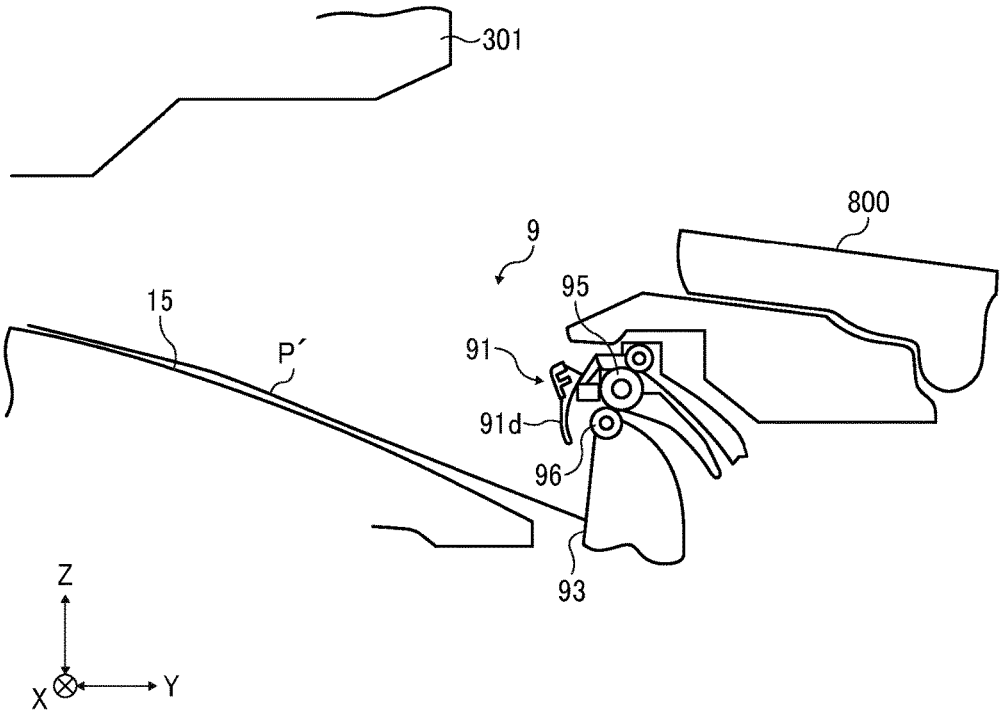
FIG. 6C is a cross sectional view illustrating the sheet stacker and the full detection feeler when the sheet is stacked in the sheet stacker during the print job.
Figure 6D:
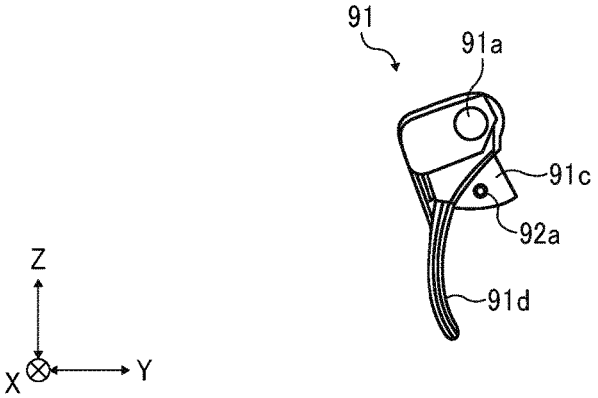
FIG. 6D is a cross sectional view illustrating movement of the full detection feeler during the print job of FIG. 6C.

When the printed sheet P' is completely discharged to the sheet stacker 15, as illustrated in FIGS. 6C and 6D, the printed sheet P' is stacked on the sheet stacker 15 located below or at a lower position relative to the contact feeler portion 91*d*.

When the contact feeler portion 91*d* of the full detection feeler 91 is separated from the printed sheet P' and the full detection feeler 91 returns to the initial standby state due to the weight of the contact feeler portion 91*d* (the state illustrated in FIGS. 5A and 5B), the blocking member 91*c* of the full detection feeler 91 returns to the state in which the light emitting part 92*a* of the photointerrupter 92 blocks the light (or the light path).

A duration of contact of the printed sheet P' (A4 size, portrait orientation) and the contact feeler portion 91*d* is approximately 2 seconds and a duration of a transmission state of the photointerrupter 92 is a constant duration (approximately 2 seconds).

According to these conditions, in a case in which the transmission state of the photointerrupter 92 is less than a predetermined duration (approximately 3 seconds) longer that the constant duration (approximately 2 seconds), even when the transmission state of the photointerrupter 92 is detected, the controller does not determine that the sheet stacker 15 is full with the printed sheets P' (sheet full) but determines that the sheet stacker 15 is not full (sheet not full). In a case in which the transmission state reaches and continues over the predetermined duration (approximately 3 seconds), the controller determines that the sheet stacker 15 is full with the printed sheets P' and determines to interrupt the print job. Then, the controller sends an instruction signal of determinations to the devices and mechanisms related to the print job to control the devices and mechanisms.

When multiple sheets P are printed, the printed sheets P' are sequentially stacked onto the sheet stacker 15. As described above, due to swing of the full detection feeler 91 in response to the sheet discharging operation of the multiple printed sheets P' to the sheet stacker 15, the blocking member 91*c* of the full detection feeler 91 repeatedly performs blockage and transmission of light of the photointerrupter 92.

As illustrated in FIGS. 7A and 7B, in a case in which the multiple printed sheets P' are stacked on the sheet stacker 15, even after the sheet discharging operation is completed, the blocking member 91*c* of the full detection feeler 91 does not block the light (or the light path) of the photointerrupter 92 (the transmission state). Since the transmission state lasts longer than the predetermined duration (approximately 3 seconds), the controller determines that the sheet stacker 15 is full with the printed sheets P'. Therefore, the controller determines to interrupt or stop the print job and sends the instruction signals to the devices and mechanisms related to the print job to stop the print job. As described above, the controller determines whether the sheet stacker 15 is full of the printed sheets P' using a sheet detector of the full detection feeler 91 and the photointerrupter 92, so as to interrupt or stop the print job.

It is to be noted that, in FIG. 7A, the printed sheets P' stacked in the sheet stacker 15 is schematically illustrated. However, the trailing end in the sheet conveying direction of each of the printed sheets P' stacked on the slope of the sheet stacker 15 contacts the sheet discharging rear end guide plate 93 disposed along the width direction to be loaded on the sheet stacker 15.

Figure 8A:
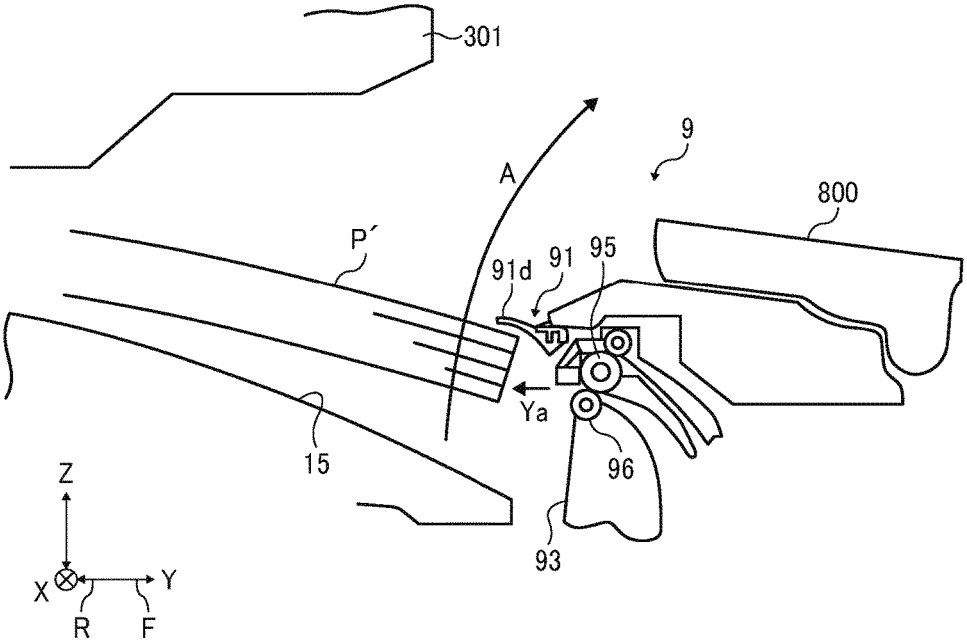
FIG. 8A is a cross sectional view illustrating inconvenience of the sheet stacker and the full detection feeler when the printed sheet P' is removed from the sheet stacker.
Figure 8B:
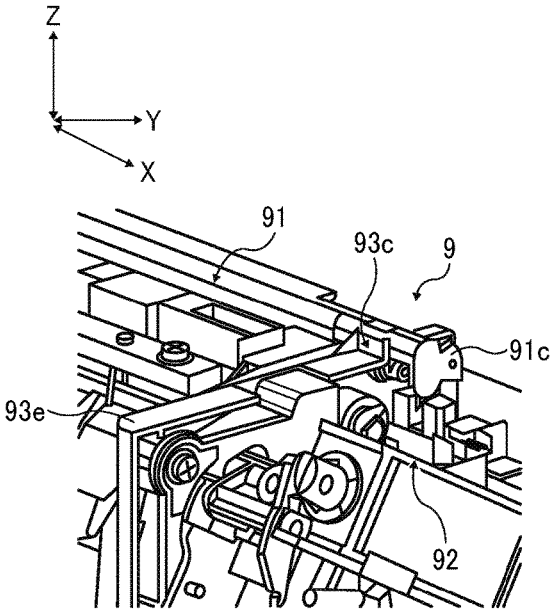
FIG. 8B is a perspective view illustrating the full detection feeler of FIG. 8A.
Figure 8C:
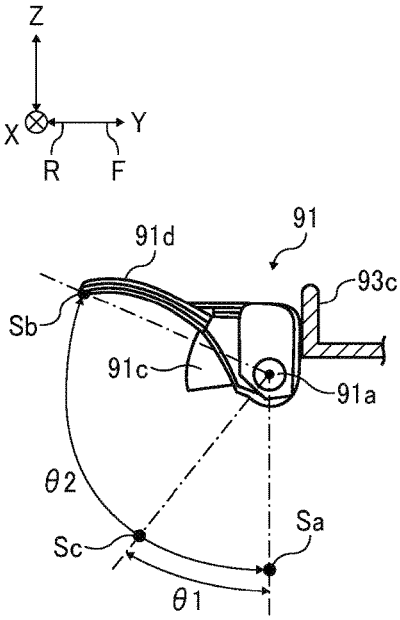
FIG. 8C is an enlarged view illustrating the full detection feeler of FIG. 8A.

A description is given of how to remove the printed sheet P', with reference to FIGS. 8A, 8B and 8C.

FIG. 8A is a cross sectional view illustrating the sheet stacker 15 and the full detection feeler 91 when the printed sheet P' is removed from the sheet stacker 15. FIG. 8B is a perspective view illustrating the full detection feeler 91 of FIG. 8A. FIG. 8C is an enlarged view illustrating the full detection feeler 91 of FIG. 8A.

As illustrated in FIGS. 8A through 8C, when the printed sheet P' is removed from the sheet stacker 15, the leading end of the contact feeler portion 91*d* of the full detection feeler 91 rotates upwardly. This rotation of the full detection feeler 91 causes a base of the full detection feeler 91 contacts a regulator 93*c* attached to the sheet discharging side guide plate 93*e* to be engaged with the regulator 93*c*. Therefore, the rotation of the full detection feeler 91 is limited, that is, the full detection feeler 91 cannot rotate further upwardly. The regulator 93*c* is a stopper of the full detection feeler 91. The regulator 93*c* is fixedly attached to a portion of the sheet discharging side guide plate 93*e*, outside from a guide surface of the sheet discharging side guide plate 93*e* in the width direction X.

As illustrated in FIG. 8C, the full detection feeler 91 is swingably disposed within a predetermined swinging range θ2 between a standby position Sa (see FIGS. 5A and 5B) at which the full detection feeler 91 is located in the standby state and a swing upper limit position Sb at which the regulator 93*c* regulates the rotation of the full detection feeler 91. Further, the full detection feeler 91 detects the height of the printed sheets P' stacked in the sheet stacker 15 within a swinging range θ1 between the standby position Sa and a full state detection position Sc (see FIGS. 7A and 7B). The standby position Sa, the swing upper limit position Sb and the full state detection position Sc illustrated in FIG. 8C are respective positions of the leading end of the contact feeler portion 91*d* of the full detection feeler 91.

When the sheet stacker 15 is full with the printed sheets P' and the controller stops the print job, the printed sheets P' stacked in the sheet stacker 15 cannot be removed from the sheet stacker 15 horizontally or in the horizontal direction to the upstream side of the sheet discharging direction Ya (i.e., to the front side F of the front-and-back direction Y), because the control unit 800 is disposed above the sheet discharging rear end guide plate 93 that rises from the bottom of the sheet stacker 15. Therefore, the printed sheet P' is firstly lifted upwardly in the vertical direction Z and then is pulled out to the front side F of the front-and-back direction Y. Specifically, the printed sheet P' is removed from the sheet stacker 15 in a movement path indicated by arrow A in FIG. 8A.

Further, a user or an operator normally uses the image forming apparatus 100 when standing at the front side of the image forming apparatus 100 as illustrated in FIG. 1B and FIG. 2 (i.e., the front side F of the front-and-back direction Y). However, the image reading device 301 is disposed at the rear side in the horizontal direction of the image forming apparatus 100 (i.e., the rear side R of the front-and-back direction Y). The image reading device 301 also functions as a ceiling of the image forming apparatus 100. In addition, the control unit 800 is disposed at the front side F of the image forming apparatus 100. Therefore, a direction to remove the printed sheet P' is limited and a space for removal of the printed sheet P' is relatively narrow. Accordingly, it is not easy to remove the printed sheet P' from the image forming apparatus 100. Further, when the printed sheet P' is removed from the sheet stacker 15, in order to reduce a distance of movement of the printed sheet P', that is, the movement path indicated by arrow A in FIG. 8A, the printed sheet P' is occasionally removed toward the front side of the image forming apparatus 100 (i.e., the front side F of the front-and-back direction Y) quickly.

At this time, since the full detection feeler 91 is disposed above the movement path A of the printed sheet P' to be removed from the sheet stacker 15, the full detection feeler 91 rotates to the state illustrated in FIG. 8A when the printed sheet P' is removed. However, since the upper limit of rotation of the full detection feeler 91 is regulated by the regulator 93*c*, when the full detection feeler 91 is rotated beyond the swing upper limit position Sb, the trailing end of the printed sheet P' is likely to be caught by the contact feeler portion 91*d* of the full detection feeler 91, and therefore the operability of removing the printed sheet V is degraded. In addition, the full detection feeler 91 can be damaged or broken and the printed sheet P' can be damaged.

Generally, in the image forming apparatus 100 illustrated in FIG. 2, in a case in which the scanner is disposed above the sheet stacker 15 of the sheet discharging device 9, the scanner acts as the ceiling of the sheet stacker 15 of the sheet discharging device 9. Since the printed sheets P' to be stacked in the sheet stacker 15 are likely to contact the scanner and easily become displaced or untidy, a full state detecting mechanism is provided to the image forming apparatus 100.

Further, when performing a full front operation, in which a jammed sheet is removed from the color laser printer 200 by opening the front cover 20 on the side on which the control unit 800 is disposed, the following inconvenience is likely to occur. In the full front operation, the trailing end of the sheet P after image formation is discharged in the sheet stacker 15 on a side close to the control unit 800. In this case, since the sheet discharging device 9 and the control unit 800 are disposed on the front side of the sheet stacker 15 (on the side of the control unit 800), it is difficult to visually recognize removal of the printed sheet P' from the sheet stacker 15, resulting in the above-described inconvenience.

In order to eliminate the above-described inconvenience, the upper limit of swing (rotation) of the full detection feeler 91 is set to a higher level, the full detection feeler 91 is likely to stay at the higher upper limit position. Therefore, the return of the full detection feeler 91 to the standby position Sa becomes unstable or the return operation of the full detection feeler 91 takes long, and therefore it is likely that an incorrect detection of the sheet full state is performed. In order to address this inconvenience, the full detection feeler 91 is set to a position at which the full detection feeler 91 stably returns to the standby position in the initial standby state and the control operation is reliably performed.

Here, a description is given of the position of the full detection feeler 91 of the sheet discharging device 9 in FIGS. 8A through 8C. In the above-described full detection feeler 91, the first swing target supports 91*a* and 91*b*, the blocking member 91*c* and the contact feeler portion 91*d* are integrally formed by resin as a single unit. The full detection feeler 91 is formed extending in the width direction X, longer than the width of the maximum sheet size usable for at least printing. The contact feeler portion 91*d* is integrally formed at a substantially center of the full detection feeler 91 that is opposed to the sheet P. The contact feeler portion 91*d* of the full detection feeler 91 swings together with the full detection feeler 91 as a single unit, in the predetermined swinging range.

In the above-described examples, after the printed sheet P' is removed, the full detection feeler 91 returns from the swing upper limit position Sb to the initial standby state, that is, the standby position Sa illustrated in FIG. 8B due to the weight thereof. However, the movement of the full detection feeler 91 is not limited thereto. For example, the full detection feeler 91 may return to the initial standby state due to a biasing force applied by a weight or a spring.

In the above description, an A4 size (portrait orientation) is used as an of a sheet size used for printing but any sheet size can be applied to this disclosure as long as the sheet is a cut sheet.

Further, the regulator 93*c* is disposed at one position illustrated in FIG. 8B in the above description but the number and position of the regulator 93*c* is not limited thereto. For example, multiple regulators 93*c* may be disposed on the sheet discharging side guide plate 93*d* in the width direction X.

As described above, the swing upper limit position Sb is set for the full detection feeler 91 in order to remove the printed sheet P' smoothly. However, when the full detection feeler 91 is rotated beyond the swing upper limit position Sb, the trailing end of the printed sheet P' is likely to be caught by the contact feeler portion 91*d* of the full detection feeler 91, and therefore the operability of removing the printed sheet P' is degraded. In addition, the full detection feeler 91 can be damaged or broken and the printed sheet P' can be damaged.

Embodiment 1

Figure 9B:
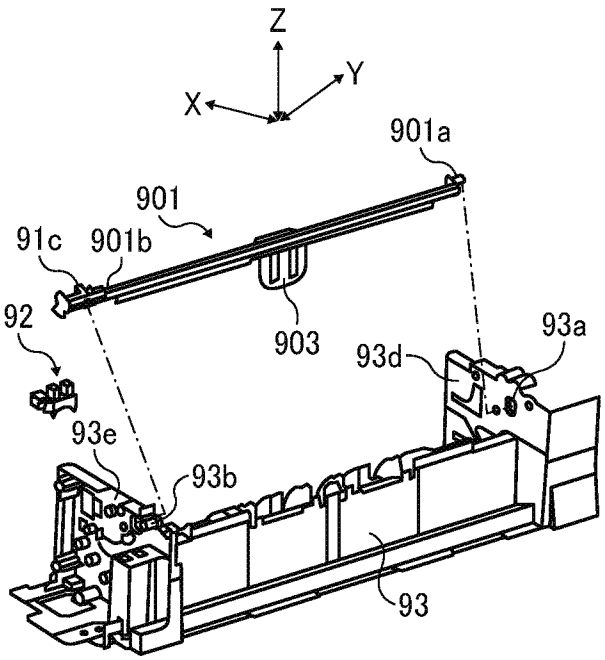
FIG. 9B is a perspective view illustrating an engaging state of the full detection feeler of FIG. 9A and the photointerrupter.
Figure 9A:
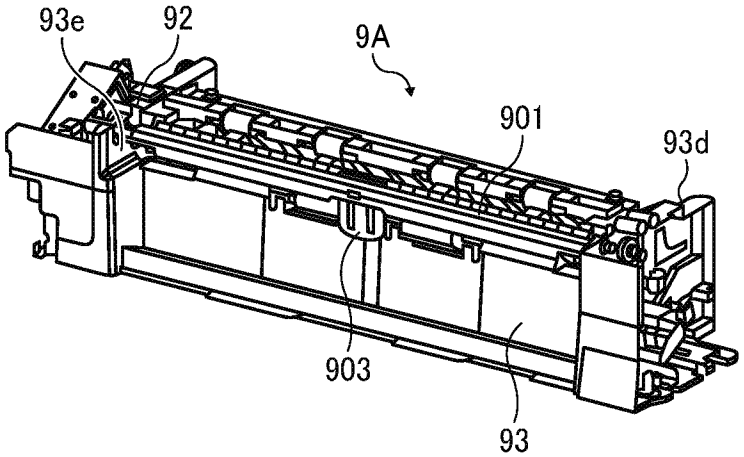
FIG. 9A is a perspective view illustrating a full detection feeler provided to a sheet discharging device according to Embodiment 1 of this disclosure, when the full detection feeler is in an initial standby state.

A description is given of a sheet discharging device according to Embodiment 1 of this disclosure, with reference to FIGS. 9A and 9B.

Specifically, FIG. 9A is a perspective view illustrating a full detection feeler 901 provided to a sheet discharging device 9A according to Embodiment 1 of this disclosure, when the full detection feeler 901 is in an initial standby state. FIG. 9B is a perspective view illustrating an engaging state of the full detection feeler 901 of FIG. 9A and the photointerrupter 92.

The sheet discharging device 9A according to Embodiment 1 illustrated in FIGS. 9A and 9B functions as a recording medium discharging device. While the sheet discharging device 9 illustrated in FIGS. 2 through 8C includes the full detection feeler 91, the sheet discharging device 9A according to Embodiment 1 includes the full detection feeler 901. The configuration and operations of the full detection feeler 901 according to Embodiment 1 are described, focusing on features different from the full detection feeler 91 illustrated in FIGS. 2 through 8C.

The full detection feeler 901 includes a sheet contact member 903 and a feeler body 902. The sheet contact member 903 functions as a contact member that is rotated or swung by contact with a sheet. The feeler body 902 is a shaft that is rotated or swung together with the sheet contact member 903 within a predetermined swinging range that is a predetermined rotating range of the sheet contact member 903. The sheet contact member 903 is attached to a substantially center in the width direction X of the feeler body 902 that is a separated part different from the sheet contact member 903.

On both left and right ends in the width direction X of the feeler body 902, first swing target supports 901*a* and 901*b* that function as first rotation target supports are mounted integrally. The first swing target supports 901*a* and 901*b* are swing fulcrums as coaxial rotation fulcrums. The first swing target support 901*a* of the full detection feeler 901 is attached and supported to the first swing support 93*a* of the sheet discharging side guide plate 93*d*. The first swing target support 901*b* of the full detection feeler 901 is attached and supported to the first swing support 93*b* of the sheet discharging side guide plate 93*e*.

Further, the photointerrupter 92 is provided in the vicinity of the first swing support 93*b* of the sheet discharging side guide plate 93*e*.

Further, a blocking member 91*c* is integrally provided at an end of the first swing target support 901*b* of the feeler body 902. The blocking member 91*c* blocks and transmits light along the light path between the light emitting part 92*a* and the light receiving part 92*b* of the photointerrupter 92 that is attached to the sheet discharging side guide plate 93*e*.

It is to be noted that movement of swing of the blocking member 91*c* that is integrally formed on the feeler body 902 of the full detection feeler 901 and the configuration and operations of sheet full detection based on blocking of light of the photointerrupter 92 are identical to the above-described configuration and operations. In addition, after the printed sheet P' is removed, the full detection feeler 901 returns from the swing upper limit position Sb to the initial standby state, that is, the standby position Sa due to the weight thereof. However, the movement of the full detection feeler 901 is not limited thereto. For example, the full detection feeler 901 may return to the initial standby state due to a biasing force applied by a weight or a spring, which is also same as the above-described configuration and operations.

Now, a description is given of a swing range of the sheet contact member 903 and the feeler body 902 of the full detection feeler 901, with reference to FIGS. 10A, 10B, 10C and 10D.

Figure 10B:
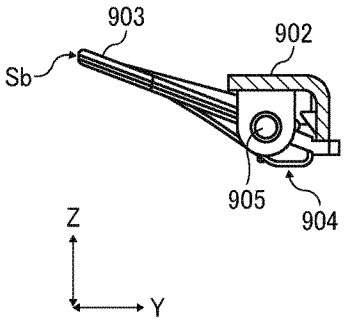
FIG. 10B is an enlarged cross sectional view illustrating the sheet contact member and the feeler body of FIG. 10A, viewed along a plane B.
Figure 10D:
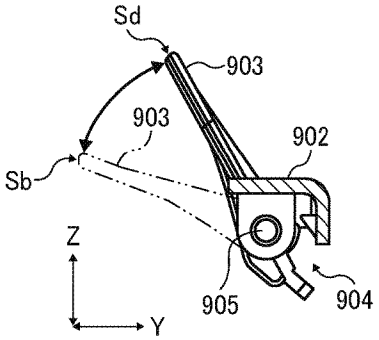
FIG. 10D is an enlarged cross sectional view illustrating the sheet contact member and the feeler body of FIG. 10C, viewed along a plane B.
Figure 10A:
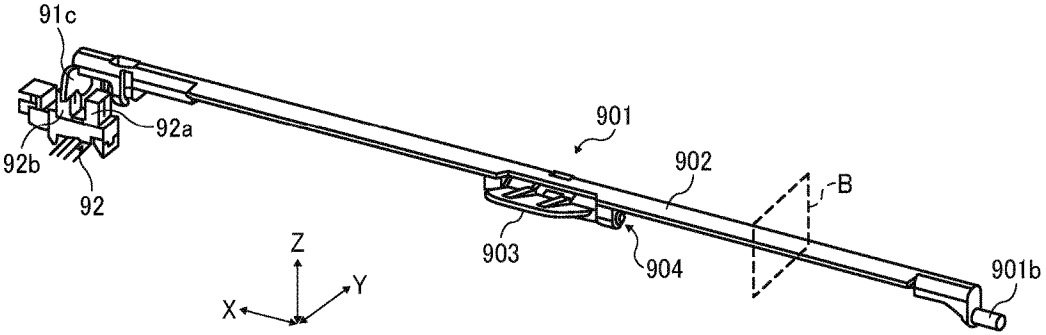
FIG. 10A is a perspective view illustrating the full detection feeler of FIGS. 9A and 9B, with the sheet contact member and the feeler body rotating together to the swing upper limit position.
Figure 10C:
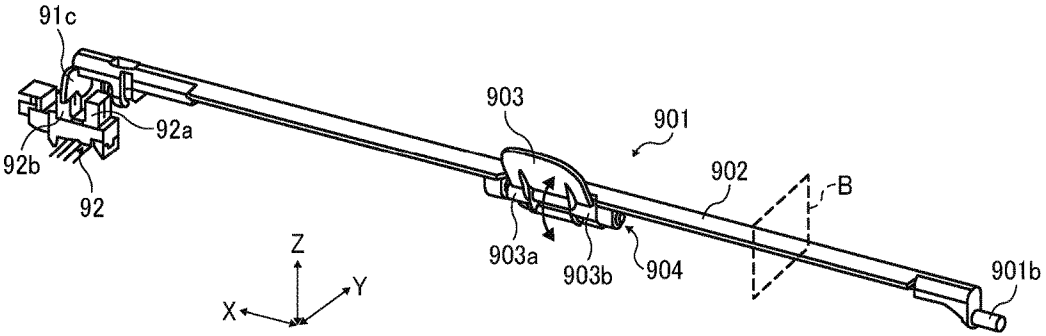
FIG. 10C is a perspective view illustrating the full detection feeler of FIGS. 9A and 9B, that the feeler body is stopped at the swing upper limit position and the sheet contact member rotates from the swing upper limit position to a retracted position.

Specifically, FIG. 10A is a perspective view illustrating the sheet contact member 903 and the feeler body 902 rotating together to the swing upper limit position Sb. FIG. 10B is an enlarged cross sectional view illustrating the sheet contact member 903 and the feeler body 902 of FIG. 10A, viewed along a plane B. FIG. 10C is a perspective view illustrating that the feeler body 902 is stopped at the swing upper limit position Sb and the sheet contact member 903 rotates from the swing upper limit position Sb to a retracted position Sd. FIG. 10D is an enlarged cross sectional view illustrating the sheet contact member 903 and the feeler body 902 of FIG. 10C, viewed along a plane B.

The sheet contact member 903 and the feeler body 902 are separate parts and are mounted on the full detection feeler 901. The sheet contact member 903 and the feeler body 902 are integrally formed by resin.

As illustrated in FIGS. 10A and 10B, the full detection feeler 901 to which the sheet contact member 903 and the feeler body 902 are integrally attached rotates about the first swing target supports 901*a* and 901*b*, to the swing upper limit position Sb that is the upper limit in the predetermined swinging range. When the full detection feeler 901 occupies the swing upper limit position Sb, the feeler body 902 contacts the regulator 93*c* of the sheet discharging side guide plate 93*e* to be engaged therewith, as illustrated in FIGS. 8B and 8C. By so doing, the further rotation of the feeler body 902 is restricted (see FIG. 14B).

As illustrated in FIGS. 10C and 10D, the sheet contact member 903 is disposed swingable to the feeler body 902 about a second swing support 904, exceeding the predetermined swinging range in the same direction as the swing direction of the feeler body 902. The second swing support 904 that functions as a rotation support is attached to the feeler body 902. The second swing support 904 supports the sheet contact member 903 to rotate to the feeler body 902, exceeding the predetermined rotation range, in the same direction as the direction of rotation of the feeler body 902 that rotates together with the sheet contact member 903 in contact with the sheet P. The detailed configuration of the second swing support 904 is described below.

According to the above-described configuration, the sheet contact member 903 and the feeler body 902 swing together to the swing upper limit position Sb and the sheet contact member 903 further rotates about the second swing support 904, exceeding the predetermined swinging range while the feeler body 902 is engaged at the swing upper limit position Sb. By so doing, the sheet contact member 903 retreats to the retracted position Sd.

The sheet contact member 903 is significantly different from the contact feeler portion 91*d* having a claw shape as illustrated in FIGS. 3A through 8C in the following features. Specifically, different from the contact feeler portion 91*d*, the sheet contact member 903 has bearings 903*a* and 903*b*, provided with a large area to contact the sheet P, and has a round chamfering portion to prevent damage to the end of the printed sheet P' when the printed sheet P' is removed from the sheet stacker 15.

In addition, the sheet contact member 903 may have a resin portion to contact the end of the printed sheet P' and have an appropriate surface treatment.

As described above, the full detection feeler 901 includes the sheet contact member 903 and the feeler body 902. The feeler body 902 includes the first swing target support 901*a* that is swingably supported by the first swing supports 93*a*, the first swing target support 901*b* that is swingably supported by the first swing support 93*b* (see FIGS. 9A and 9B), and the second swing support 904.

A detailed description is given of the configuration of the sheet contact member 903 and the second swing support 904 of the full detection feeler 901, with reference to FIGS. 11A, 11B, 11C, 11D, 12A, 12B, 13A, 13B and 13C.

Figure 12A:
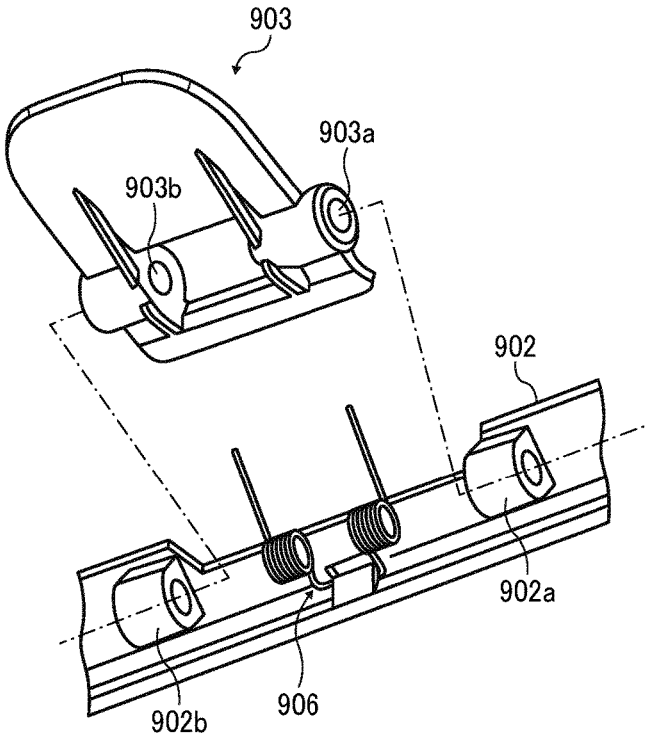
FIGS. 12A and 12B are diagrams illustrating yet another area around the sheet contact portion and the rotation support of the full detection feeler of FIGS. 9A and 9B.
Figure 12B:
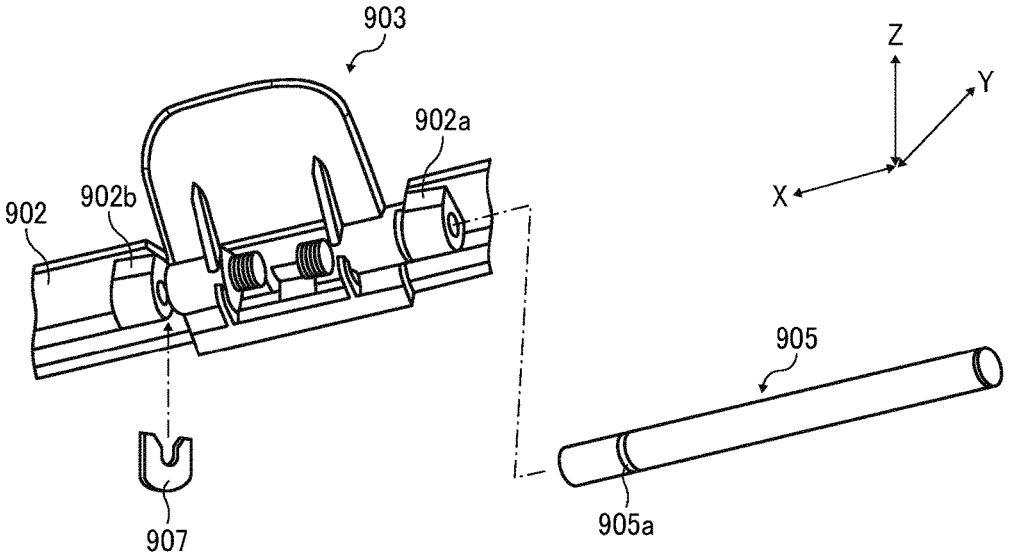
Figure 13A:
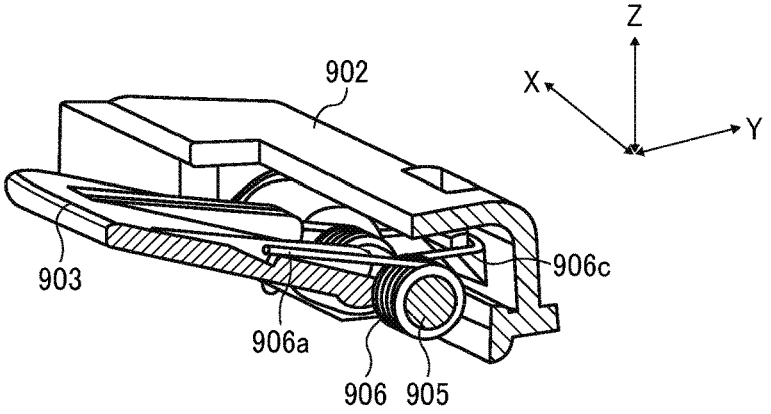
FIGS. 13A, 13B and 13C are diagrams illustrating yet another area around the sheet contact portion of the rotation support and the full detection feeler of FIGS. 9A and 9B.
Figure 13B:
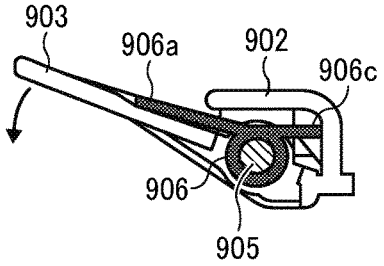
Figure 13C:
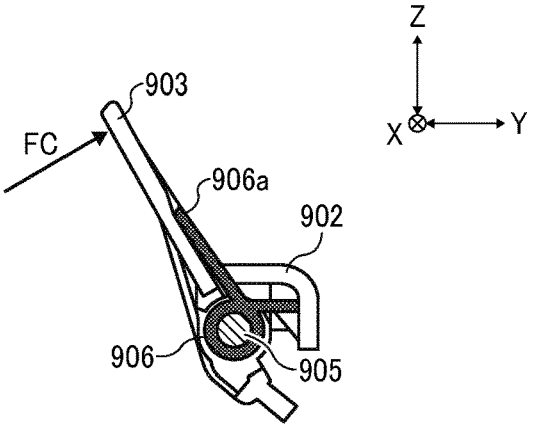

FIGS. 11A, 11B, 11C and 11D are diagrams illustrating an area around the sheet contact portion and a rotation support of the full detection feeler of FIGS. 9A and 9B. FIGS. 12A and 12B are diagrams illustrating yet another area around the sheet contact portion and the rotation support of the full detection feeler of FIGS. 9A and 9B. FIGS. 13A, 13B and 13C are diagrams illustrating yet another area around the sheet contact portion of the rotation support and the full detection feeler of FIGS. 9A and 9B.

Figure 11A:
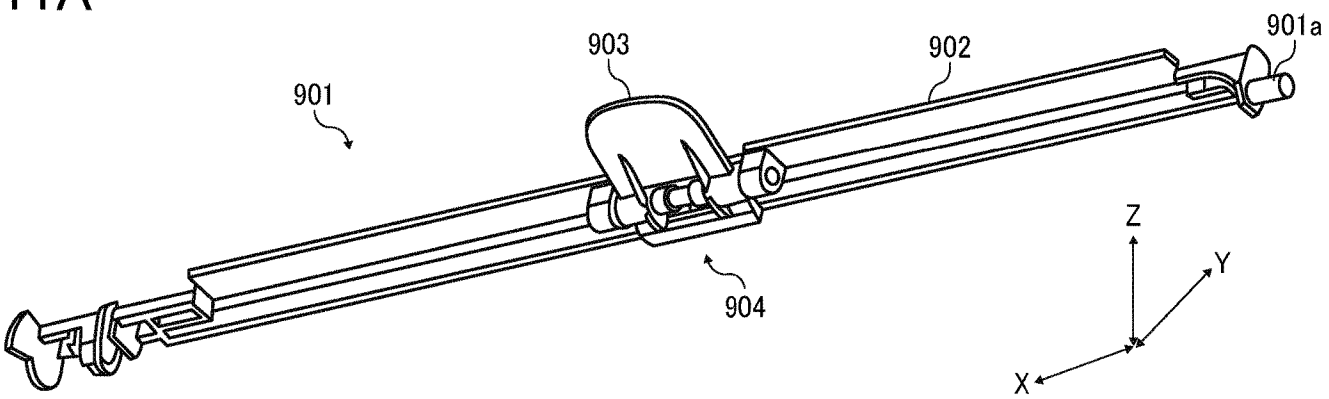
FIGS. 11A, 11B, 11C and 11D are diagrams illustrating an area around the sheet contact portion and a rotation support of the full detection feeler of FIGS. 9A and 9B.
Figure 11B:
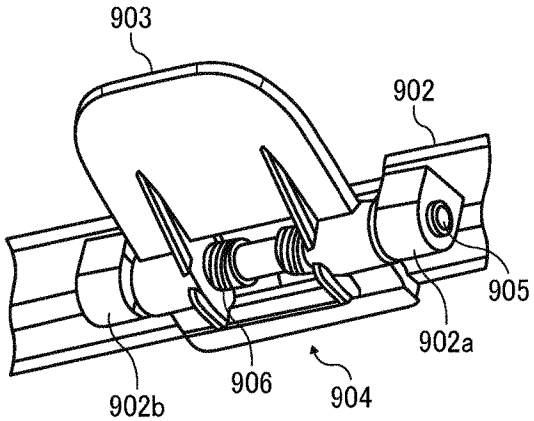

As illustrated in FIGS. 11A and 11B, the second swing support 904 is part of the feeler body 902 and includes bearings 902*a* and 902*b* and a shaft 905. The bearings 902*a* and 902*b* are integrally formed in the feeler body 902. The shaft 905 in inserted into the bearings 902*a* and 902*b*. A spring receiver 902*c* is disposed in the vicinity of the second swing support 904 and is integrally formed in the feeler body 902. The spring receiver 902*c* includes a torsion coil spring 906 attached thereto in an attachment state.

Figure 11C:
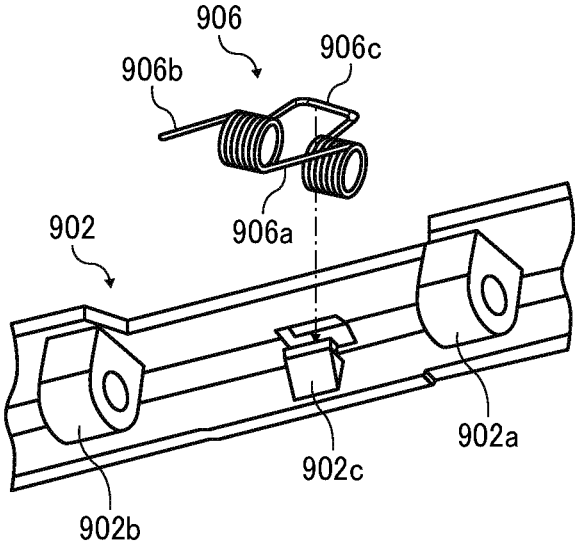
Figure 11D:
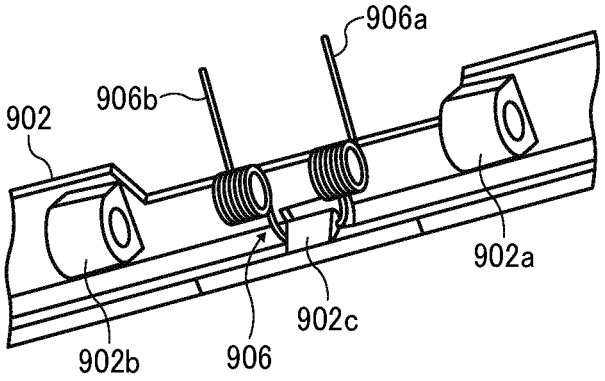

As illustrated in FIGS. 11C and 11D, the torsion coil spring 906 that functions as a biasing force setting body is a pair member in which two coil portions are connected by a connecting member 906*c*. The torsion coil spring 906 is attached to the feeler body 902 in a state in which the connecting member 906*c* is engaged to a recessed portion formed in the spring receiver 902*c* of the feeler body 902.

Further, in a state in which the sheet contact member 903 is arranged as illustrated in FIG. 12A, the shaft 905 is attached to pass through the bearings 902*a* and 902*b* of the feeler body 902, the bearings 903*a* and 903*b* of the sheet contact member 903 and an inner circumference of the torsion coil spring 906 attached to the spring receiver 902*c*, as illustrated in FIG. 12B.

Then, a retaining ring 907 is attached to a groove 905*a* of the shaft 905 that is attached as described above. Accordingly, the shaft 905 is prevented from coming off in a thrust direction (i.e., an axial direction). As a result of this assembly, the sheet contact member 903 can swing to the feeler body 902 about the shaft 905 that functions as a fulcrum and is supported by the bearings 903*a* and 903*b*.

As illustrated in FIGS. 13A and 13B, the connecting member 906*c* of the torsion coil spring 906 is attached to the spring receiver 902*c* of the feeler body 902. The torsion coil spring 906 has one end portion 906*a* and an opposed end portion 906*b*, both of which are locked to the sheet contact member 903. According to this configuration, as illustrated in FIG. 13B, the biasing force applied by the torsion coil spring 906 acts in a direction to swing the sheet contact member 903 about the shaft 905, to the feeler body 902 in the counterclockwise direction. Specifically, the torsion coil spring 906 functions as a biasing force setting body to set a biasing force in an opposite direction to the direction of rotation of the feeler body 902 so as to rotate the sheet contact member 903 at the second swing support 904, in the direction of rotation of the feeler body 902, to the feeler body 902.

Accordingly, as illustrated in FIG. 13C, when a pressing force FC is applied from outside against the biasing force applied by the torsion coil spring 906, the sheet contact member 903 rotates about the shaft 905 in the clockwise direction. After the pressing force FC is released, the sheet contact member 903 returns to the state illustrated in FIGS. 13A and 13B by the biasing force applied by the torsion coil spring 906.

FIGS. 14A, 14B, 14C and 14D are diagrams illustrating removal of stacked printed sheet P' with the full detection feeler 901 according to Embodiment 1.

Figure 14A:
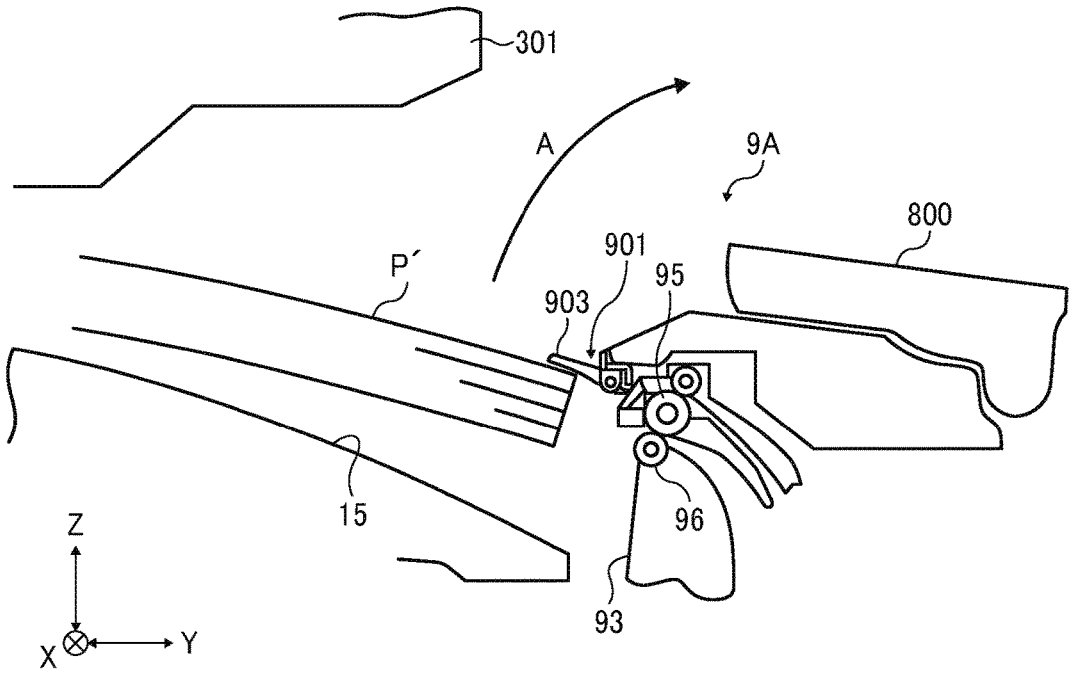
FIGS. 14A, 14B, 14C and 14D are diagrams illustrating removal of stacked sheet with the full detection feeler according to Embodiment 1.
Figure 14B:
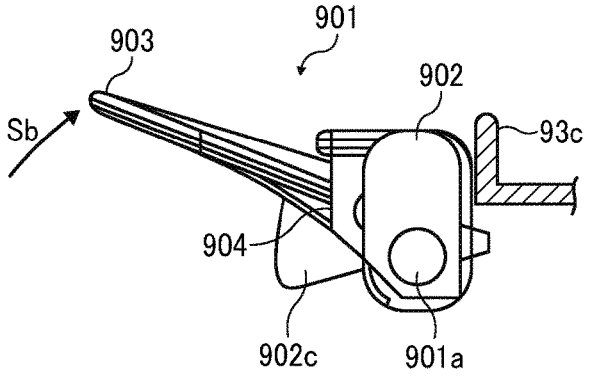

As illustrated in FIG. 14A, when the printed sheets P' fully stacked in the sheet stacker 15 are removed in a direction indicated by arrow A, the sheet contact member 903 of the full detection feeler 901 is lifted by the trailing end of the stacked printed sheets P'. Therefore, the sheet contact member 903 in contact with the trailing end of the printed sheets P' moves (rotates) together with the feeler body 902, about the first swing target supports 901*a* and 902*b*, to the swing upper limit position Sb as illustrated in FIG. 14B.

Figure 14C:
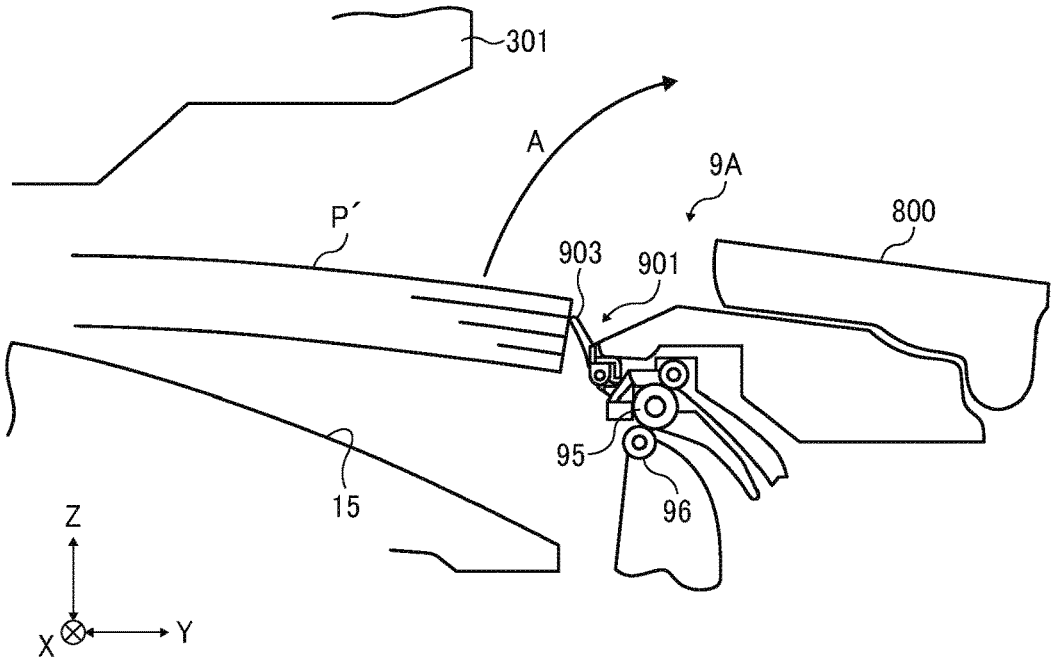
Figure 14D:
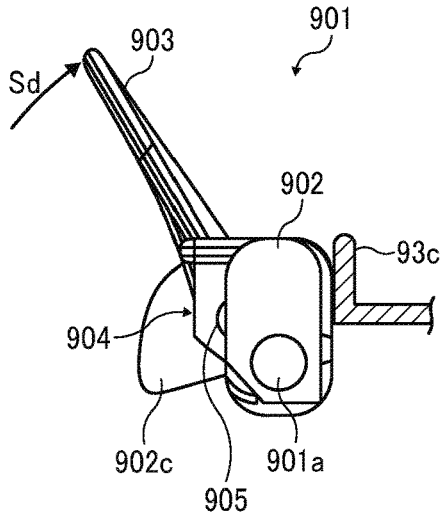

Then, as illustrated in FIG. 14C, when the printed sheets P' are further removed from the sheet stacker 15, the sheet contact member 903 alone moves (rotates) about the shaft 905 of the second swing support 904, and swings to the retracted position Sd beyond the predetermined swinging range. The swinging direction of the sheet contact member 903 about the second swing support 904 is the same direction as the sheet removing direction of the printed sheets P' stacked in the sheet stacker 15 (or the direction separating from the sheet stacker 15).

Now, a description is given of the configuration and operations including a pressing operations of the sheet contact member 903 of the full detection feeler 901, with reference to FIGS. 15A, 15B, 15C, 16A, 16B, 16C, 17A, 17B and 17C.

Figure 15A:
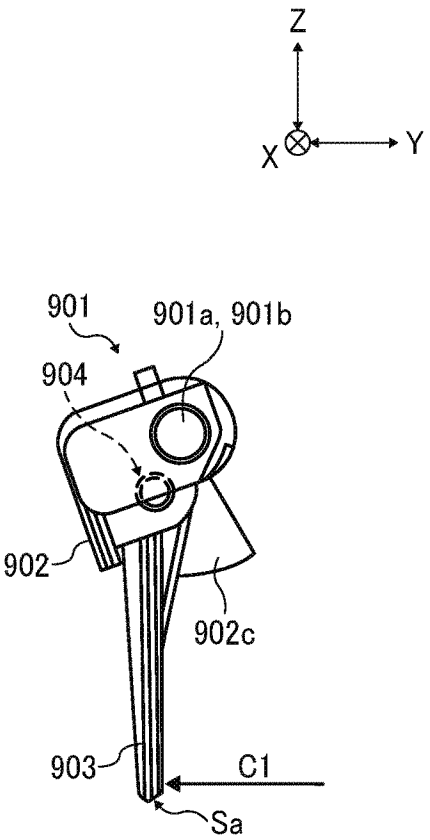
FIGS. 15A, 15B and 15C are diagrams illustrating a configuration and operations of the full detection feeler according to Embodiment 1.

In a state illustrated in FIG. 15A, the sheet contact member 903 at the standby position Sa is pressed in a direction indicated by arrow C, thereby moving (rotating) the sheet contact member 903 and the feeler body 902 (i.e., the full detection feeler 901) together about the first swing target supports 901*a* and 901*b*. A force to be applied for the above-described operation is referred to as a "first pressing force." That is, the first pressing force is a force to press the sheet contact member 903 by conveyance (discharge) of the printed sheets P'. In other words, the first pressing force is also a force to rotate the feeler body 902 together with the sheet contact member 903 in the direction of rotation of the feeler body 902 by pressing the sheet contact member 903 by the printed sheets P' stacked in the sheet stacker 15.

Figure 15B:
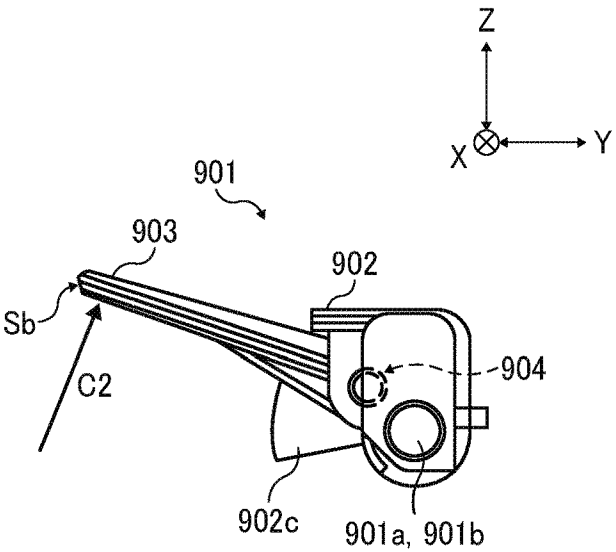

After detection of the sheet full state, the full detection feeler 901 moves to the swing upper limit position Sb illustrated in FIG. 15B, along with removal of the printed sheets P' from the sheet stacker 15.

Figure 15C:
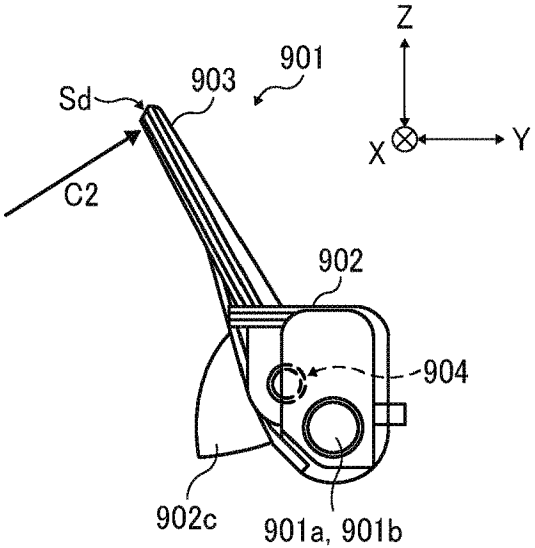

In a state illustrated in FIG. 15B, the sheet contact member 903 is pressed further in a direction indicated by arrow C2, thereby moving (rotating) the sheet contact member 903 about the second swing support 904, to the feeler body 902. A force to be applied for the above-described operation is referred to as a "second pressing force." That is, the second pressing force is a force to press the sheet contact member 903 by removal of the printed sheets P'. With the second pressing force, the sheet contact member 903 that has moved (rotated) about the second swing support 904 moves (rotates) to the retracted position Sd as illustrated in FIG. 15C, which is similar to FIG. 14D.

Consequently, the biasing force applied against the second pressing force is set based on the biasing force applied by the biasing member of the torsion coil spring 906 (see FIGS. 13A through 13C. However, the setting of the biasing force is not limited thereto and any other configuration can be applied to this disclosure.

The biasing force applied against the second pressing force is greater than the pressing force by which the printed sheet P' is conveyed and the sheet contact member 903 is pressed and smaller than the pressing force by which the sheet contact member 903 is pressed along with removal of the printed sheet P'. That is, the biasing force of the torsion coil spring 906 is set to meet the relation of "the first pressing force<the second pressing force" and the relation of "the biasing force<the second pressing force."

During the print job, the load to the full detection feeler corresponds to the contact force by the printed sheet P' during conveyance for discharging, and therefore the full detection feeler swings within a range in which the full detection feeler moves by the first swing support. Therefore, the first pressing force does not exceed the biasing force of the torsion coil spring 906 in the above-described state. Consequently, the sheet contact member 903 does not move (rotate) about the second swing support 904 and the sheet contact member 903 has a constant relative position to the feeler body 902. Accordingly, the full state detection can be performed by the photointerrupter 92.

Further, the torsion coil spring 906 that is used to apply the biasing force against the second pressing force is attached to the shaft 905 of the second swing support 904 (through the inner circumference of the shaft 905), and therefore an effect of space saving can be achieved.

As described above, the biasing force against the second pressing force is greater than the first pressing force and smaller than the second pressing force. However, the maximum biasing force is set so as not to cause any damage to the sheet by the second pressing force (for example, the printed sheet P' is scratched or torn) when the printed sheet P' stacked in the sheet stacker 15 is removed. In this setting, the type of the sheet P' to be removed (for example, a thin paper and a film sheet are damaged more easily than a regular sheet) is taken into consideration. However, instead of considering the type of the sheet P', an adjusting mechanism by which the biasing force can be adjusted may be provided.

It is to be noted that the biasing force against the second pressing force is not limited to be applied by the biasing member including the torsion coil spring 906. For example, a biasing force against the second pressing force may be applied according to a self-weight moment of the sheet contact member (a contact member) and the feeler body (a shaft) having the material, center of gravity, shape and so forth appropriately devised to generate the moment) or may be applied by a weight as a separate part attached to the sheet contact member (a contact member) and the feeler body (a shaft). However, the biasing force is set to cause the sheet contact member 903 to return to the standby position Sa.

Figure 16A:
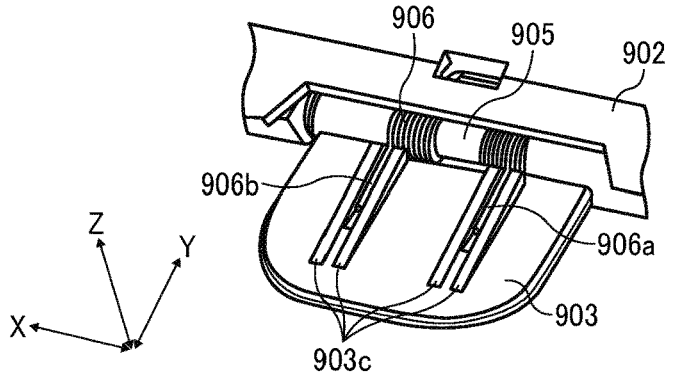
FIGS. 16A, 16B and 16C are diagrams illustrating the configuration and further operations of the full detection feeler according to Embodiment 1.

As illustrated in FIG. 16A, a pair of ribs 903*c* is provided on an opposite side of the sheet contact member 903, on which the sheet contact member 903 and the printed sheet P' contact with each other. The pair of ribs 903*c* functions as a protect portion to protect the one end portion 906*a* and the opposed end portion 906*b* of the torsion coil spring 906. The pair of ribs 903*c* has a length greater than the core diameter of the torsion coil spring 906 and is disposed to enclose the one end portion 906*a* and the opposed end portion 906*b* of the torsion coil spring 906. By so doing, the end portions of the torsion coil spring 906 are safe without being exposed or touched by mistake. Further, the pair of ribs 903*c* can prevent the torsion coil spring 906 from coming off.

Figure 16B:
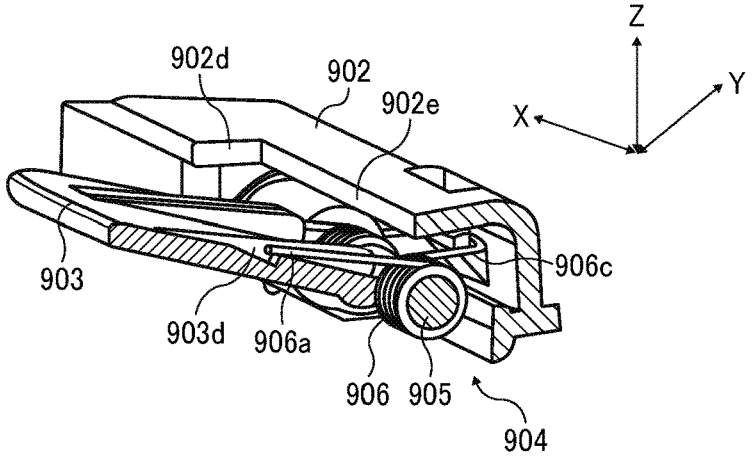

As illustrated in FIG. 16B, a recess 903*d* is formed in the sheet contact member 903 in order to provide a gap distance between the leading end of the one end portion 906*a* of the torsion coil spring 906 and the leading end of the opposed end portion 906*b* of the torsion coil spring 906 and the sheet contact member 903. According to this configuration, when the sheet contact member 903 is swung or rotated about the shaft 905 of the second swing support 904, the circumferential surface of the core at the end portions of the torsion coil spring 906 contact the sliding surface in the recess 903*d*, which can prevent a burred portion formed at the leading end of the sheet contact member 903 from contacting the sliding surface in the recess 903*d*. Accordingly, the sheet contact member 903 can return to the swing upper limit position and further to the standby state reliably, and therefore the sheet full state detection can be performed reliably.

It is to be noted that, since the leading end of the one end portion 906*a* of the torsion coil spring 906 and the leading end of the opposed end portion 906*b* of the torsion coil spring 906 are deformed (compress or extend) in the front-and-back direction Y along with swing of the sheet contact member 903, the recess 903*d* is formed by taking the deformation of the torsion coil spring 906.

Figure 16C:
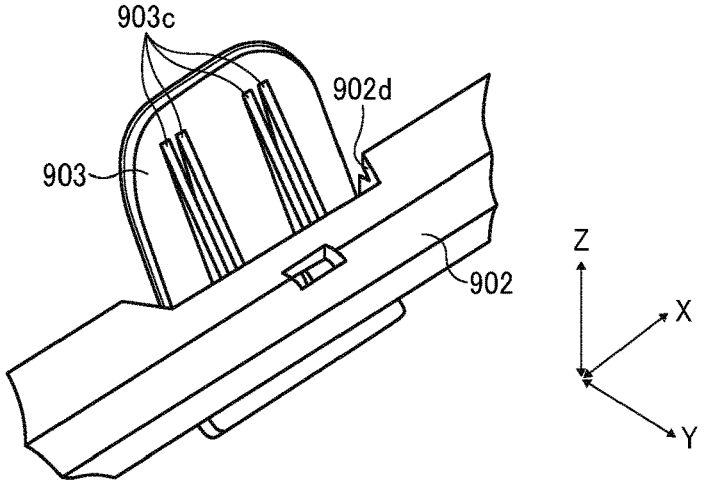

Further, as illustrated in FIG. 16B, when the sheet contact member 903 is swung or rotated about the shaft 905 of the second swing support 904, a cut portion 902*d* that functions as a retracting portion to retract the sheet contact member 903 is formed in the feeler body 902. According to this configuration, as illustrated in FIG. 16C, the cut portion 902*d* can be used as a swinging range of the sheet contact member 903 to the retracted position Sd (see FIGS. 14C, 14D and 15C), and therefore a further space saving in the layout can be achieved.

As illustrated in FIG. 16B, a first regulator 902*e* is provided to the feeler body 902 on the printed sheet removing side, as a plane in the width direction X. The first regulator 902*e* regulates the swinging range of the sheet contact member 903 when the sheet contact member 903 swings about the second swing support 904, exceeding the predetermined swinging range.

By disposing the first regulator 902*e* in the vicinity of the feeler body 902, the height of accumulation of the parts can be reduced, and therefore variation in the second pressing force can be reduced. Accordingly, the operability without variation can be achieved.

The feeler body 902 is elastically formed by resin and extends in the width direction X. Therefore, the material of the feeler body 902 is set to resin, even after the swing of the feeler body 902 is regulated by the first regulator 902*e*, by using twist and bend of the feeler body 902 due to elasticity of resin material, the sheet contact member 903 can be swung to the position illustrated in FIGS. 17A and 17B. That is, after the sheet contact member 903 alone reaches the retracted position Sd, the sheet contact member 903 swings from the retracted position Sd further to a flexibly retracted position Se due to elastic deformation of the feeler body 902, as illustrated in FIG. 17B.

Figure 17A:
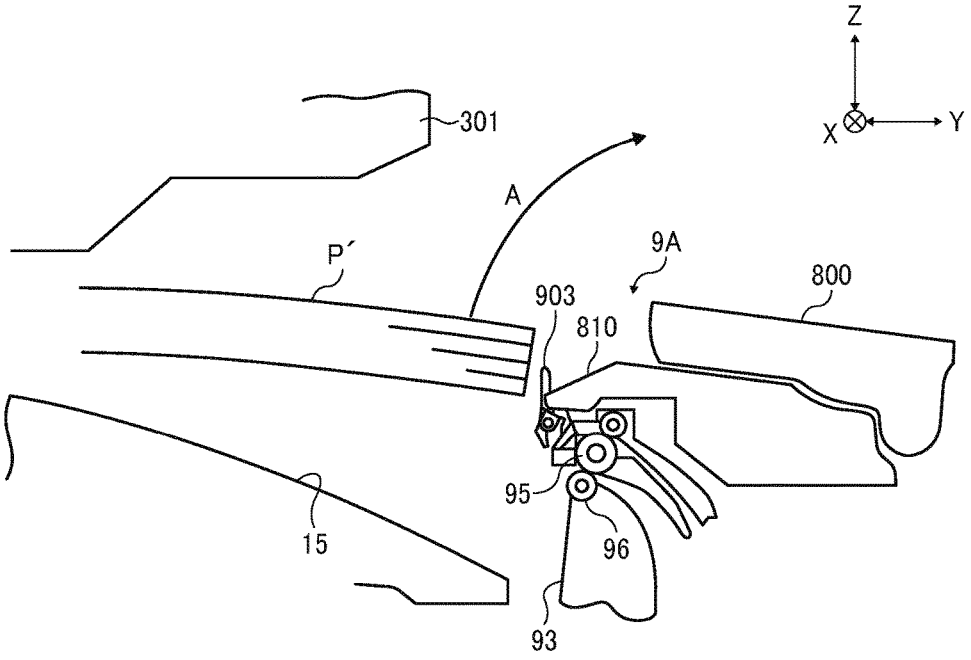
FIGS. 17A, 17B and 17C are diagrams illustrating the configuration and yet further operations of the full detection feeler according to Embodiment 1.
Figure 17B:
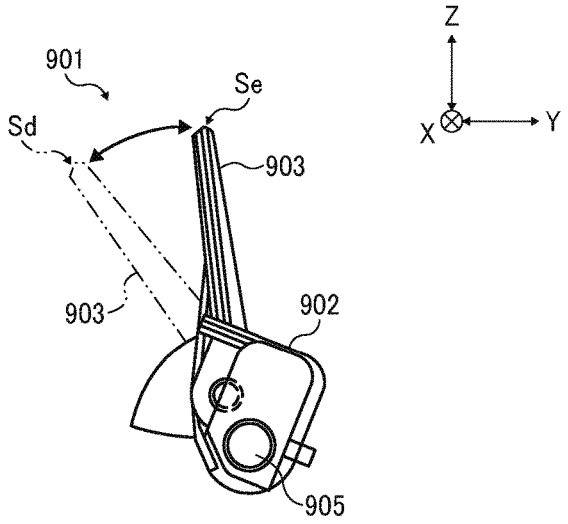
Figure 17C:
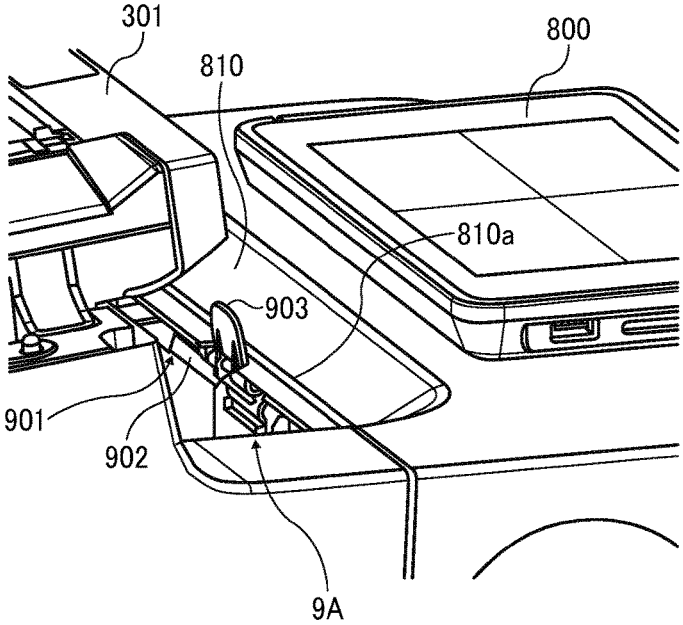

When the feeler body 902 is elastically deformed to cause the sheet contact member 903 to swing to the flexibly retracted position Se as illustrated in FIGS. 17A and 17B, a second regulator 810*a* that regulates the sheet contact member 903 is provided to a cover 810 that is disposed at the upper part of the sheet discharging device 9A. The second regulator 810*a* is formed on a vertical plane along the vertical direction Z of the cover 810.

As described above, by providing the second regulator 810*a* to the cover 810 at the upper part of the sheet discharging device 9A when the feeler body 902 further moves due to elastic twist thereof, the further twist of the feeler body 902 can be prevented, and therefore breakage of the sheet contact member 903 can also be prevented. Accordingly, the operability of removal of the sheets stacked in the sheet stacker can be enhanced.

As described above, the sheet discharging device 9 according to Embodiment 1 of this disclosure includes a sheet discharging body such as the sheet discharging roller 95 and the sheet discharging driven roller 96, a sheet stacker such as the sheet stacker 15, a contact body such as the sheet contact member 903, a shaft such as the feeler body 902, and a stack height detector such as the full detection feeler 91 and the photointerrupter 92. The sheet discharging body is configured to discharge the sheet such as the sheet P'. The sheet stacker is a stacker on which the sheet discharged by the sheet discharging body. The contact body is configured to rotate while contacting the sheet. The shaft is configured to rotate together with the contact body in a range of rotation of the contact body. The stack height detector is configured to detect that the height of the sheet stacked on the sheet stacker is equal to or higher than the predetermined height through detection of rotation of the shaft rotating with the contact body in contact with the sheet. The sheet discharging device according to Embodiment 1 of this disclosure further includes a rotary body support configured to rotatably support the contact body to the shaft that rotates together with the contact body in contact with the sheet, extending the range of rotation, in a same direction as the direction of rotation of the shaft.

According to Embodiment 1, when the printed sheet P' is removed from the sheet stacker 15, the printed sheet P' and the sheet contact member 903 contact with each other, and the sheet contact member 903 swings and retracts in the substantially same direction as the sheet removing direction of the printed sheet P' stacked on the sheet stacker 15. Accordingly, the preferable performance of sheet removal of the sheet stacked on the sheet stacker 15 can be maintained without retracting and returning the sheet contact member 903, and therefore the operability can be enhanced.

In addition, the full detection feeler 901 can be prevented from being damaged or broken and the printed sheet P' can be prevented from being damaged. Further, the failure caused by forgetting of return of the sheet contact member 903 can be prevented before the occurrence.

Figure 18:
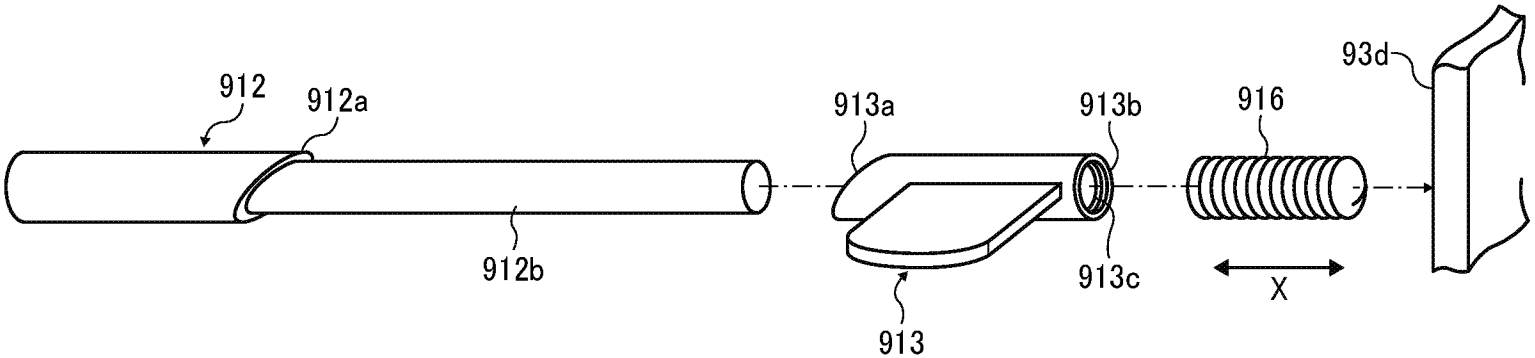
FIG. 18 is a diagram illustrating a configuration of the full detection feeler having a second pressing force, according to Variation of this disclosure.
Figure 19A:
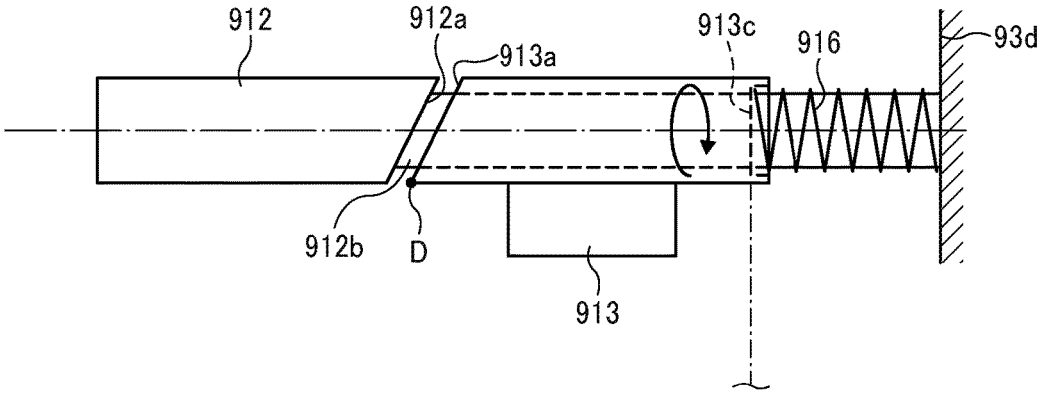
FIGS. 19A and 19B are diagrams diagram illustrating movement of the full detection feeler according to Variation of FIG. 18.
Figure 19B:
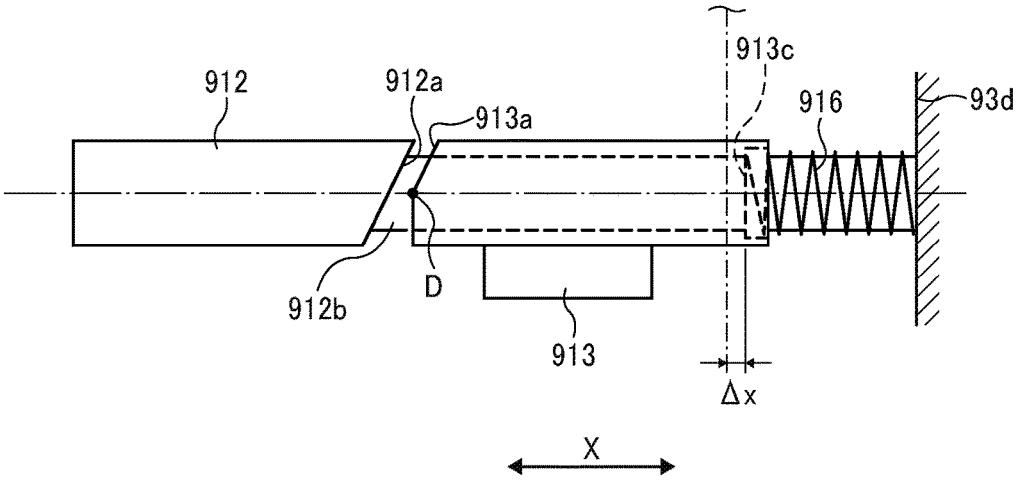

Now, a description is given of the biasing force against the second pressing force, with reference to FIGS. 18, 19A and 19B.

FIG. 18 is a diagram illustrating a configuration of the full detection feeler 901 having the second pressing force, according to Variation of this disclosure. FIGS. 19A and 19B are diagrams illustrating movement of the full detection feeler 901 according to Variation of FIG. 18, to explain the principle of generation of the biasing force against the second pressing force of this Variation.

The configuration of Variation illustrated in FIG. 18 is different from the configuration of Embodiment 1 illustrated in FIGS. 9A through 17C, in that a sheet contact member 913 is employed instead of the sheet contact member 903, that a feeler body 912 is employed instead of the feeler body 902, and that a compression coil spring 916 is employed instead of the torsion coil spring 906. The feeler body 912 according to Variation is different from the feeler body 902 according to Embodiment 1, in that a taper 912*a*, which functions as a second taper, can be engaged with the taper 913*a* of the sheet contact member 913 and is formed in part of the feeler body 912 in the width direction X and in that the taper 912*a* of the feeler body 912 is formed integrally with a shaft 912*b* that functions as a second swing support.

It is to be noted that the first swing support according to Variation is identical to the first swing support illustrated in FIGS. 9A through 10D. Since the first swing support is not directly related to the explanation of the principle of generation of the biasing force against the second pressing force of Variation, the description of the first swing support is omitted here.

As illustrated in FIG. 18, the sheet contact member 913 includes a spring receiver 913*c* in an inner circumference of a shaft through hole 913*b* formed at the right side end of the sheet contact member 913. The left side end of the compression coil spring 916 is attached to and engaged with the spring receiver 913*c*.

As illustrated in FIG. 18, the feeler body 912, the sheet contact member 913 and the compression coil spring 916 are disposed in this order from the left. In assembly, the shaft 912*b* of the feeler body 912 is inserted into the shaft through hole 913*b* of the sheet contact member 913, and then is inserted into the inner circumference of the compression coil spring 916. The right end portion of the compression coil spring 916 is supported by a wall of the sheet discharging side guide plate 93*d*. Consequently, the sheet contact member 913 is constantly biased by the biasing force of the compression coil spring 916 in the thrust direction of the feeler body 912, and therefore the pressing force is generated. That is, the compression coil spring 916 functions as a biasing force setting member to set the biasing force in an opposite direction to the direction of rotation of the feeler body 912 so as to rotate the sheet contact member 913 at the shaft 912*b* that functions as a second swing support, in the direction of rotation of the feeler body 912, to the feeler body 912.

As illustrated in FIG. 19A, while the taper 912*a* of the feeler body 912 and the taper 913*a* of the sheet contact member 913 are contacted and engaged with each other, the sheet contact member 913 is biased by the compression coil spring 916 in the thrust direction of the feeler body 912. In the above-described state, the feeler body 912 contacts the regulator 93*c* to be locked by the regulator 93*c*, that is, the feeler body 912 is in a locked state, which is the same as in FIGS. 14A through 14D. The fixed position of the taper 913*a* of the sheet contact member 913 in this state is represented as "D". From this fixed position D, the sheet contact member 913 is swung in a direction indicated by arrow in FIG. 19A against the biasing force of the compression coil spring 916 that biases the feeler body 912 that is in the locked state by the regulator 93*c*, exceeding the predetermined swinging range. Consequently, the fixed position D of the fixed position of the taper 913*a* of the sheet contact member 913 moves to the position as illustrated in FIG. 19B. As a result, the sheet contact member 913 causes the compression coil spring 916 to shrink by the amount of Ax. Since this amount acts as the pressing force to the sheet contact member 913, the biasing force to be applied against the second pressing force can be set.

According to this configuration, the compression coil spring 916 that is used in the thrust direction can be directly attached to the shaft 912*b* of the feeler body 912 that functions as a second swing support. Therefore, the configuration according to Variation can achieve the same effect as the configuration according to Embodiment 1.

Embodiment 2

The configuration of Embodiment 1 and the configuration of Variation are applied to the sheet discharging device 9A that is included in the image forming apparatus 100 and functions as a sheet discharging device that conveys a sheet-like transfer target medium such as a sheet to be discharged from the image forming apparatus 100. These configurations can be applied to a sheet conveying device that feeds a sheet-like transfer target medium such as a sheet to be fed in the image forming apparatus 100, as described in Embodiment 2. In this case, if a known technique is employed to a sheet conveying device that feeds a sheet-like transfer target medium such as a sheet to be fed in an image forming apparatus, when a jammed sheet is removed from the sheet conveying device that includes a sheet detection feeler to detect the sheet by swinging a contact member that contacts the fed sheet, the same inconvenience as the sheet detection feeler of the above-described sheet discharging device may occur.

Specifically, instead of the above-described inconvenience that occurs when the sheet is removed from the sheet discharging tray in the sheet discharging device that includes the full detection feeler, the same inconvenience is generated when a paper jam occurs in the vicinity of the sheet detection feeler in a sheet conveyance passage of the sheet conveying device.

When a jammed sheet is removed from a jammed sheet remaining position in the vicinity of the sheet detection feeler, the jammed sheet is caught by the sheet detection feeler, and therefore the operability of removal of the jammed sheet becomes worse and the sheet detection feeler is damaged or broken. Further, when the sheet detecting feeler is employed instead of the full detection feeler and a manual retraction of the sheet detecting feeler is performed to remove the jammed sheet after retracting the sheet detection feeler manually to a position at which the jammed sheet does not contact, there are many operation processes to take, which is troublesome. Furthermore, when the machine is operated (when the printing operation is performed), the sheet needs to be returned manually before the operation. Therefore, when the sheet detection feeler is not returned, the sheet full state is not detected. Accordingly, prevention of a sheet stacking failure and a paper jam is fairly costly.

Now, a description is given of a sheet conveying device 700 according to Embodiment 2 of this disclosure.

Figure 20:
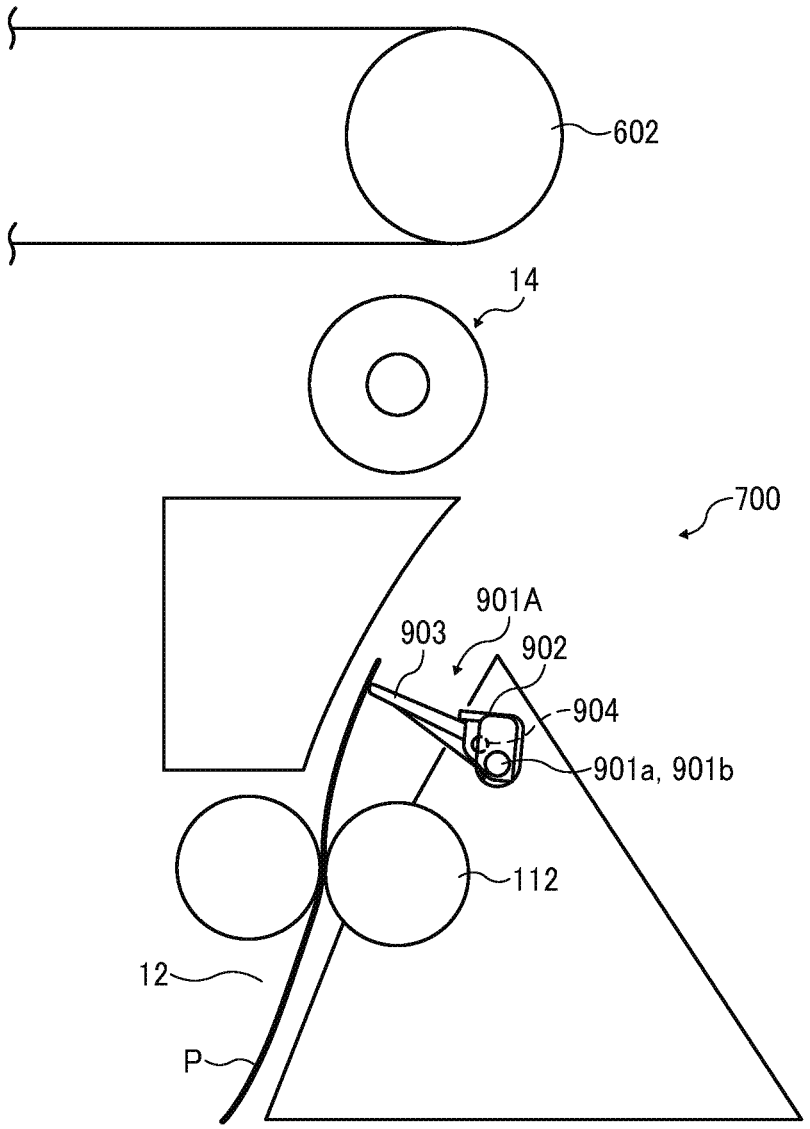
FIG. 20 is a diagram illustrating a main part of the sheet conveying device according to Embodiment 2 of this disclosure.

FIG. 20 is a diagram illustrating a main part of the sheet conveying device 700 according to Embodiment 2 of this disclosure. Specifically, FIG. 20 illustrates the sheet conveying device 700 that exposes the main part with the front cover 20 of FIG. 2 open.

The front cover 20 includes the sheet conveying unit 70 (see FIG. 2) that supports the secondary transfer roller 7 and the right side roller of the pair of registration rollers 14 and opens and closes relative to the apparatus body of the color laser printer 200, as illustrated in FIG. 2.

As illustrated in FIG. 20, the configuration according to Embodiment 2 is different from the configuration according to Embodiment 1, in that a sheet detection feeler 901A is applied to the sheet conveying device 700, instead of the full detection feeler 901 included in the sheet discharging device 9A.

The sheet detection feeler 901A is not used as a detector to detect the height of the sheets stacked in the sheet stacker 15, together with the full detection feeler 901 and the photointerrupter 92, but is used as a detector to detect passage of the sheet P one by one in the sheet conveying device 700, together with the photointerrupter 92.

Similar to the configuration according to Embodiment 1 described above, the sheet detection feeler 901A includes the sheet contact member 903, the feeler body 902 and the second swing support 904. The sheet contact member 903 functions as a contact body that swings together with the sheet while contacting the sheet. The feeler body 902 that functions as a shaft that swings together with the sheet contact member 903 in the range of rotation of the sheet contact member 903. The second swing support 904 is provided to the feeler body 902. The configuration and functions of the sheet detection feeler 901A are identical to the full detection feeler 901, except that the above-described features. Accordingly, the presence or absence of the sheet P is determined with a sheet detecting member such as the sheet detection feeler 901A and the photointerrupter 92 to interrupt or stop the print job.

As described above, the sheet conveying device such as the sheet conveying device 700 according to Embodiment 2 of this disclosure includes a contact body such as the sheet contact member 913, a shaft such as the feeler body 912, and a sheet detector such as the full detection feeler 91 and the photointerrupter 92. The contact body is configured to rotate while contacting the sheet. The shaft is configured to rotate together with the contact body in a range of rotation of the contact body. The sheet detector is configured to detect presence of the sheet through detection of rotation of the shaft rotating with the contact body in contact with the sheet. The sheet conveying device according to Embodiment 2 of this disclosure further includes a rotary body support configured to rotatably support the contact body to the shaft that rotates together with the contact body in contact with the sheet, extending the range of rotation, in a same direction as the direction of rotation of the shaft.

According to Embodiment 2, the performance of sheet conveyance can be enhanced without retracting and returning the sheet contact member 903, and therefore the sheet contact member 903 and the sheet can be prevented from being damaged or torn. Further, the failure caused by forgetting of return of the sheet contact member 903 can be prevented before the occurrence.

An image forming apparatus to which this disclosure is applied is explained with the image forming apparatus 100 that forms image by electrophotography. However, the configuration of an image forming apparatus to which this disclosure is applied is not limited to the image forming apparatus 100. For example, any image forming apparatus can be applied as long as the image forming apparatus includes a sheet discharging device to discharge a recording medium. For example, this disclosure can be applied to an inkjet image forming apparatus that forms an image using at least one liquid inkjet print head, a printing apparatus such as a stencil printing machine, a post processing device or finisher including at least one function of a sorting function, a punching function and a binding function, or a multifunction machine having the above-described functions.

Further, the sheet conveying device is not limited to a sheet conveying device disposed in the sheet conveyance passage in the vicinity of the pair of registration rollers as described above. For example, the sheet conveying device may be disposed in a sheet conveyance passage in the vicinity of a multiple step sheet feeder and a bank type sheet feeder.

In the above-described embodiments, the sheet P is used as a sheet-like transfer target medium that is conveyed or on which an image is formed. However, the sheet P is not limited thereto but also includes thick paper, postcard, envelope, plain paper, thin paper, coated paper, art paper, tracing paper, and the like. Further, as a transfer target medium other than a paper material, the sheet P further includes a non-paper material such as OHP sheet, OHP film, resin film, and any other sheet-shaped material to be conveyed or on which an image can be formed.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

What is claimed is:

1. A sheet discharging device comprising:

a sheet conveying device including, a contact body configured to rotate while contacting a sheet in conveyance, a shaft configured to rotate together with the contact body in a range of rotation of the contact body, a sheet detector configured to detect presence of the sheet through detection of rotation of the shaft rotating with the contact body in contact with the sheet, and a rotary body support configured to rotatably support the contact body to the shaft that rotates together with the contact body in contact with the sheet, extending the range of rotation, in a same direction as the direction of rotation of the shaft, a sheet discharging body configured to discharge the sheet;

a sheet stacker on which the sheet is discharged by the sheet discharging body, the sheet detector being a stack height detector configured to detect that a height of the sheet stacked on the sheet stacker is equal to or higher than a predetermined height;

a biasing force setting body configured to set a biasing force in a direction opposite the direction of rotation of the shaft, operable to rotate the contact body in the direction of rotation of the shaft on the rotary body support;

a first taper mounted on the contact body; and a second taper mounted on an end of the shaft and configured to engage with the first taper, wherein the shaft rotates, in a state in which the first taper and the second taper are engaged with each other, and wherein the biasing force setting body is set with a compression spring configured to bias the shaft toward a thrust direction in a state in which the first taper and the second taper are engaged with each other.

2. The sheet discharging device according to claim 1, wherein, when a force to rotate the shaft in the direction of rotation together with the contact body while pressing the sheet against the contact body is represented as a first pressing force, a relation that the first pressing force is smaller than the biasing force is met.

3. The sheet discharging device according to claim 1, wherein the biasing force setting body is a torsion coil spring.

4. The sheet discharging device according to claim 3, wherein the contact body has a protect portion configured to protect the torsion coil spring.

5. The sheet discharging device according to claim 3, wherein a gap is provided between one end of the torsion coil spring and the contact body.

6. The sheet discharging device according to claim 1, further comprising:

a retracting portion to which the contact body is retracted when the contact body is rotated by the rotary body support.

7. The sheet discharging device according to claim 1, further comprising:

a first regulator configured to regulate the range of rotation of the contact body when the rotary body support attempts to rotate the contact body beyond the range of rotation of the contact body.

8. The sheet discharging device according to claim 1, further comprising:

a reading portion disposed above the sheet stacker.

9. An image forming apparatus comprising:

the sheet discharging device according to claim 1.

10. A sheet discharging device comprising:

a sheet conveying device including, a contact body configured to rotate while contacting a sheet in conveyance, a shaft configured to rotate together with the contact body in a range of rotation of the contact body, a sheet detector configured to detect presence of the sheet through detection of rotation of the shaft rotating with the contact body in contact with the sheet, and a rotary body support configured to rotatably support the contact body to the shaft that rotates together with the contact body in contact with the sheet, extending the range of rotation, in a same direction as the direction of rotation of the shaft, a sheet discharging body configured to discharge the sheet;

a sheet stacker on which the sheet is discharged by the sheet discharging body, the sheet detector being a stack height detector configured to detect that a height of the sheet stacked on the sheet stacker is equal to or higher than a predetermined height; and a cover disposed at an upper part of the sheet discharging device, wherein the shaft has a first regulator configured to regulate the range of rotation of the contact body when the contact body is rotated by the rotary body support beyond the range of rotation of the contact body, the shaft is elastically formed with resin, and the cover is provided with a second regulator configured to regulate the range of rotation of the contact body when the contact body is rotated by the rotary body support, after the contact body is regulated by the first regulator.

11. The sheet discharging device according to claim 10, further comprising:

a biasing force setting body configured to set a biasing force in a direction opposite the direction of rotation of the shaft, operable to rotate the contact body in the direction of rotation of the shaft on the rotary body support.

12. The sheet discharging device according to claim 10, further comprising:

a reading portion disposed above the sheet stacker.

13. An image forming apparatus comprising:

the sheet discharging device according to claim 10.

* * * * *